US008664553B2

(12) United States Patent
Yuba et al.

(10) Patent No.: US 8,664,553 B2
(45) Date of Patent: Mar. 4, 2014

(54) SWITCH DEVICE AND CONNECTOR

(75) Inventors: Takashi Yuba, Tokyo (JP); Daiei Iwamoto, Tokyo (JP); SeungSeok Beak, Tokyo (JP); Koichi Kiryu, Nagano (JP); Akio Nakamura, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 99 days.

(21) Appl. No.: 13/541,826

(22) Filed: Jul. 5, 2012

(65) Prior Publication Data

US 2013/0037401 A1 Feb. 14, 2013

(30) Foreign Application Priority Data

Aug. 11, 2011 (JP) ..... 2011-176407

(51) Int. Cl.
*H01H 1/02* (2006.01)

(52) U.S. Cl.
USPC ..... 200/268; 218/22

(58) Field of Classification Search
USPC ..... 200/268, 269, 262, 400, 238; 218/22, 218/33, 146
See application file for complete search history.

(56) References Cited

U.S. PATENT DOCUMENTS 3,564,184 A * 2/1971 Gauthier et al. ..... 200/244
4,038,626 A * 7/1977 Haydu et al. ..... 337/4
4,477,704 A * 10/1984 Mori et al. ..... 218/148
4,489,225 A * 12/1984 Masuda et al. ..... 218/149
4,604,596 A * 8/1986 Yokoyama et al. ..... 335/14
4,628,163 A * 12/1986 Mori et al. ..... 218/151
4,761,626 A * 8/1988 Teraoka ..... 335/16
5,003,137 A * 3/1991 Tateishi et al. ..... 218/151
5,164,693 A * 11/1992 Yokoyama et al. ..... 335/14
5,583,328 A * 12/1996 Mitsuhashi et al. ..... 218/33
6,441,709 B2 * 8/2002 Pohl ..... 335/195
8,242,394 B2 * 8/2012 Mueller et al. ..... 200/268
2011/0011650 A1 * 1/2011 Klinghult ..... 178/18.03

FOREIGN PATENT DOCUMENTS

JP 05-082208 4/1993
JP 2003-031301 1/2003

* cited by examiner

*Primary Examiner* — Gary Paumen
(74) *Attorney, Agent, or Firm* — IPUSA, PLLC

(57) ABSTRACT

A switch device includes first and second contacting portions including first and second fixed contacting portions and first and second movable contacting portions, respectively, the first fixed contacting portion and the second fixed contacting portion being configured to be electrically connected to one of a power source and an electronic device while the first movable contacting portion and the second movable contacting portion are configured to be electrically connected to the other of the power source and the electronic device; a first electric arc runner provided near at least one of the first fixed contacting portion and the first movable contacting portion; and a second electric arc runner provided near at least one of the second fixed contacting portion and the second movable contacting portion.

11 Claims, 26 Drawing Sheets

SWITCH DEVICE AND CONNECTOR

BACKGROUND OF THE INVENTION

1. Field of the Invention

The present invention relates to a switch device and a connector.

2. Description of the Related Art

Generally, an electrical or electronic device is driven by supplying electric power from a power source of the like. When supplying the electric power from the power source or the like, the electric power is supplied to the electrical or electronic device through connectors. The connectors for connecting the electrical or electronic device and the power source may be a combination of a jack type connector and a plug type connector configured to be fitted in the jack type connector, as described in Patent Documents 1, Patent Documents 2 and the like.

Recently, as a countermeasure for global warming or the like, supplying of electric power of a direct current with a high voltage has been considered even for the power transmission in a local area. By using the electric power of a direct current with a high voltage, the power loss at the conversion of the voltage, the power transmission or the like can be reduced and it is not necessary to use a heavy cable. Especially, as an information device such as a server or the like consumes a large amount of electric power, supplying of the electric power of a direct current with a high voltage is desirable for the information device.

However, if the voltage of the electric power supplied to the electrical or electronic device is high, the electric power may cause some effects on a human body, or some effects on an operation of electronic components.

When such electric power of a direct current with a high voltage is used for an information device such as a server or the like, it is necessary to provide connectors which are different from connectors used for a general-purpose commercial power source of an alternating current. Further, as the connectors may be handled by a human when installing or maintaining the device, it is necessary to care for the effects on the human body or the like as well.

Further, if the electric power supplied from the power source exceeds 100 V or is direct current with a high voltage, when a switch device is incorporated in a connector, a current commercially available switch cannot be used as it is. For example, when the electric power supplied from the power source is direct current with 400 V, it may not be safe to use a switch device, which is currently used for electric power of an alternating current with 100 V as safety and reliability are not ensured.

PATENT DOCUMENT

[Patent Document 1] Japanese Laid-open Patent Publication No. H05-82208

[Patent Document 2] Japanese Laid-open Patent Publication No. 2003-31301

SUMMARY OF THE INVENTION

According to an embodiment, there is provided a switch device including a first contacting portion including a first fixed contacting portion and a first movable contacting portion configured to contact the first fixed contacting portion; a second contacting portion including a second fixed contacting portion and a second movable contacting portion configured to contact the second fixed contacting portion, the first fixed contacting portion and the second fixed contacting portion being configured to be electrically connected to one of a power source and an electronic device while the first movable contacting portion and the second movable contacting portion are configured to be electrically connected to the other of the power source and the electronic device; a first electric arc runner provided near at least one of the first fixed contacting portion and the first movable contacting portion and having a function to attract an arc discharge generated between the first fixed contacting portion and the first movable contacting portion; and a second electric arc runner provided near at least one of the second fixed contacting portion and the second movable contacting portion and having a function to attract an arc discharge generated between the second fixed contacting portion and the second movable contacting portion.

According to another embodiment, there is provided a connector for electrically connecting the power source and the electronic device, including the above switch device; and a first fitting terminal and a second fitting terminal to be fitted with terminals of another connector.

Note that also arbitrary combinations of the above-described constituents, and any exchanges of expressions in the present invention, made among method, device, system, and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
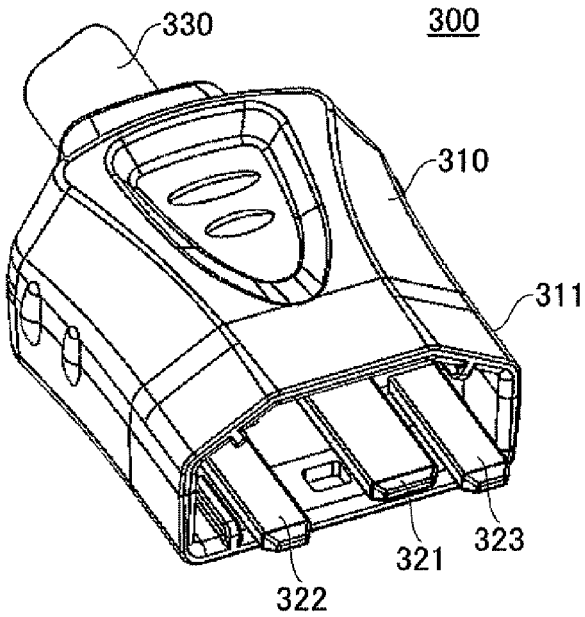
FIG. 1 is a perspective view of an example of a plug connector.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

A switch device and a connector of embodiments are configured to correspond to a high voltage. However, in the following embodiments, the expression "high voltage" does not mean a "direct current of over 750 V" which is defined by the electrical equipment technical standards or a "direct current of higher than or equal to 1500 V" which is an international standard defined by the International Electrotechnical Commission (IEC). Instead, the expression "high voltage" means a voltage that exceeds a safety extra low voltage (a direct current of less than 60 V). In other words, the "high voltage" in the following embodiments means a voltage higher than or equal to 60 V.

First Embodiment (Structure of Connector)

The structure of a connector of a first embodiment is explained.

Figure 4:
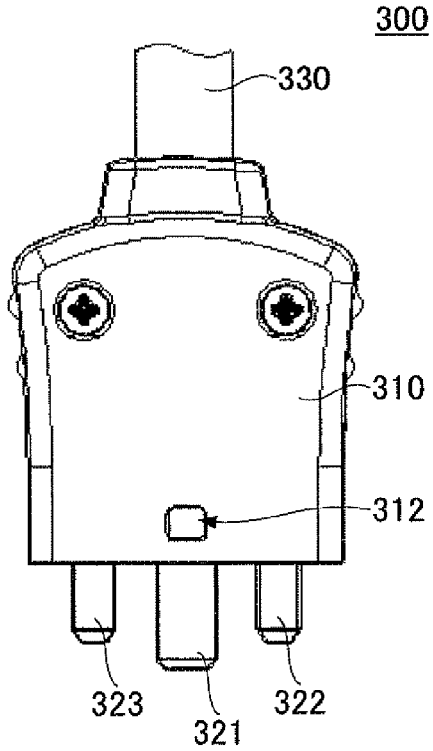
FIG. 4 is a bottom view of an example of the plug connector.
Figure 5:
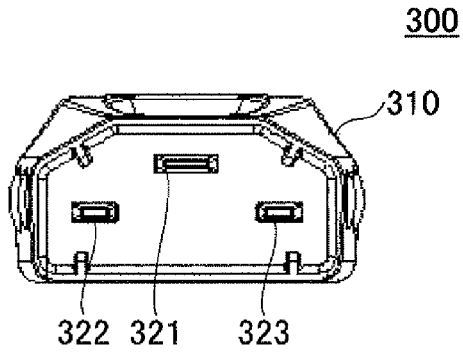
FIG. 5 is an elevation view of an example of the plug connector.
Figure 6:
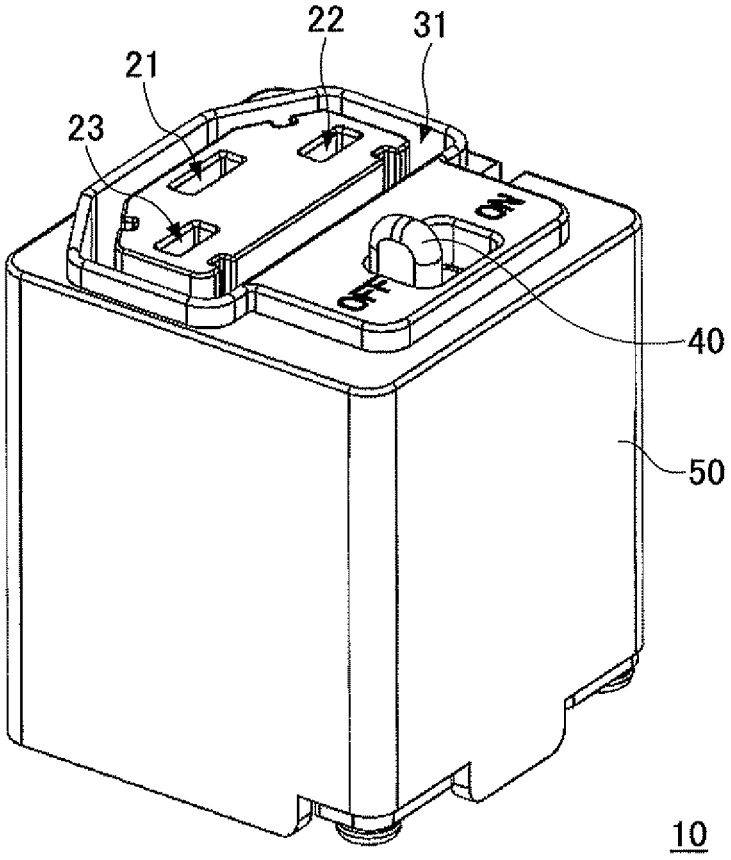
FIG. 6 is a perspective view of an example of a jack connector of a first embodiment.
Figure 7:
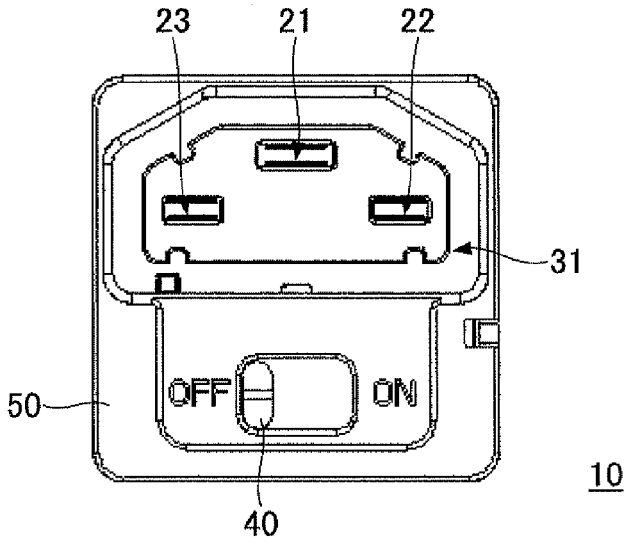
FIG. 7 is an elevation view of an example of the jack connector of the first embodiment.
Figure 8:
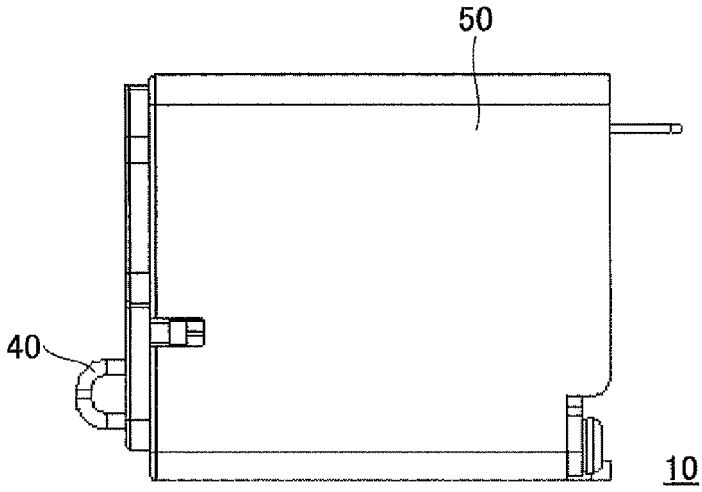
FIG. 8 is a side view of an example of the jack connector of the first embodiment.

The connector of the embodiment is a jack connector 10 shown in FIG. 6 to FIG. 8 which is to be connected to a plug connector 300 (which is an example of another connector) shown in FIG. 1 to FIG. 5. Hereinafter, a connected structure of the plug connector 300 and the jack connector 10 is referred to as a connector as well.

First, the structure of the plug connector 300 is explained with reference to FIG. 1 to FIG. 5.

Figure 2:
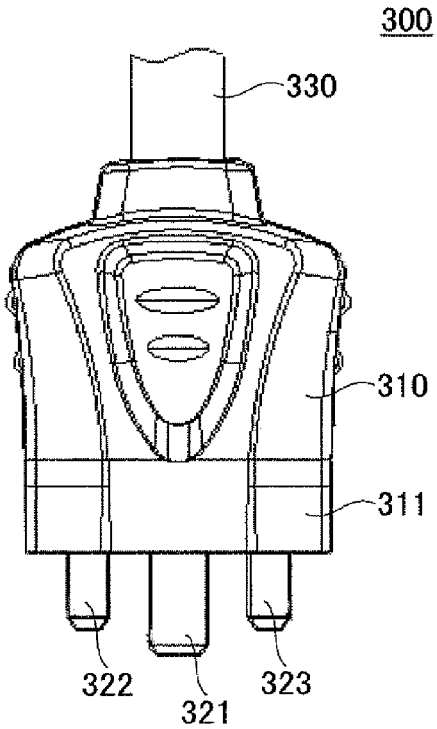
FIG. 2 is a top view of an example of the plug connector.
Figure 3:
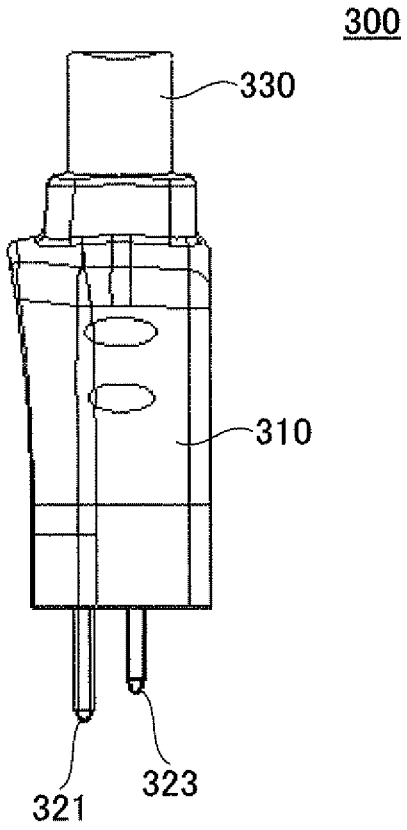
FIG. 3 is a side view of an example of the plug connector.

FIG. 1 is a perspective view of the plug connector 300, FIG. 2 is a top view of the plug connector 300, FIG. 3 is a side view of the plug connector 300, FIG. 4 is a bottom view of the plug connector 300, and FIG. 5 is an elevation view of the plug connector 300.

The plug connector 300 includes a cover 310, three plug terminals 321, 322 and 323, and a cable 330. Further, the cover 310 of the plug connector 300 is provided with a protection portion 311 and an opening 312 (see FIG. 4).

The cover 310 is made of an insulator or the like, for example. The plug terminals 321, 322 and 323 are provided at one side of the cover 310. The plug terminal 321 is a GND terminal and formed to be longer than the plug terminals 322 and 323. The plug terminals 322 and 323 (an example of terminals of the other connector) are configured to be electrically connected to terminals of the jack connector 10 so that electric power is supplied, as will be explained later.

The protection portion 311 is provided at the one side of the cover 310 to surround a part of the plug terminals 321, 322 and 323. The cable 330 is connected to the cover 310 at the other side of the cover 310. In this embodiment, the plug connector 300 is configured to be electrically connected to an electric device via the cable 330. The opening 312 is provided to fix the plug connector 300 with the jack connector 10 when the plug connector 300 is connected to the jack connector 10.

Next, the structure of the jack connector 10 of the embodiment is explained with reference to FIG. 6 to FIG. 8.

FIG. 6 is a perspective view of the jack connector 10, FIG. 7 is an elevation view of the jack connector 10 and FIG. 8 is a side view of the jack connector 10.

The jack connector 10 includes a housing 50 and an operation unit 40. Further, the jack connector 10 is provided with jack openings 21, 22 and 23 to which the plug terminals 321, 322 and 323 of the plug connector 300 are to be inserted, respectively, and a groove portion 31 to which the protection portion 311 of the plug connector 300 is to be inserted. The housing 50 covers the entirety of the jack connector 10. The jack openings 22 and 23 are an example of a first fitting terminal and a second fitting terminal. In this embodiment, as will be explained later, the jack connector 10 is configured to be electrically connected to a power source.

The operation unit 40 is provided to operate a switch device, which will be explained later, for controlling whether to supply electric power from the power source when the plug connector 300 and jack connector 10 are physically connected. The operation unit 40 is slidable between an "ON" position and an "OFF" position. By sliding the operation unit 40, the switch device is operated and whether to supply the electric power from the power source via the jack connector 10 to the plug connector 300 is controlled.

Figure 9:
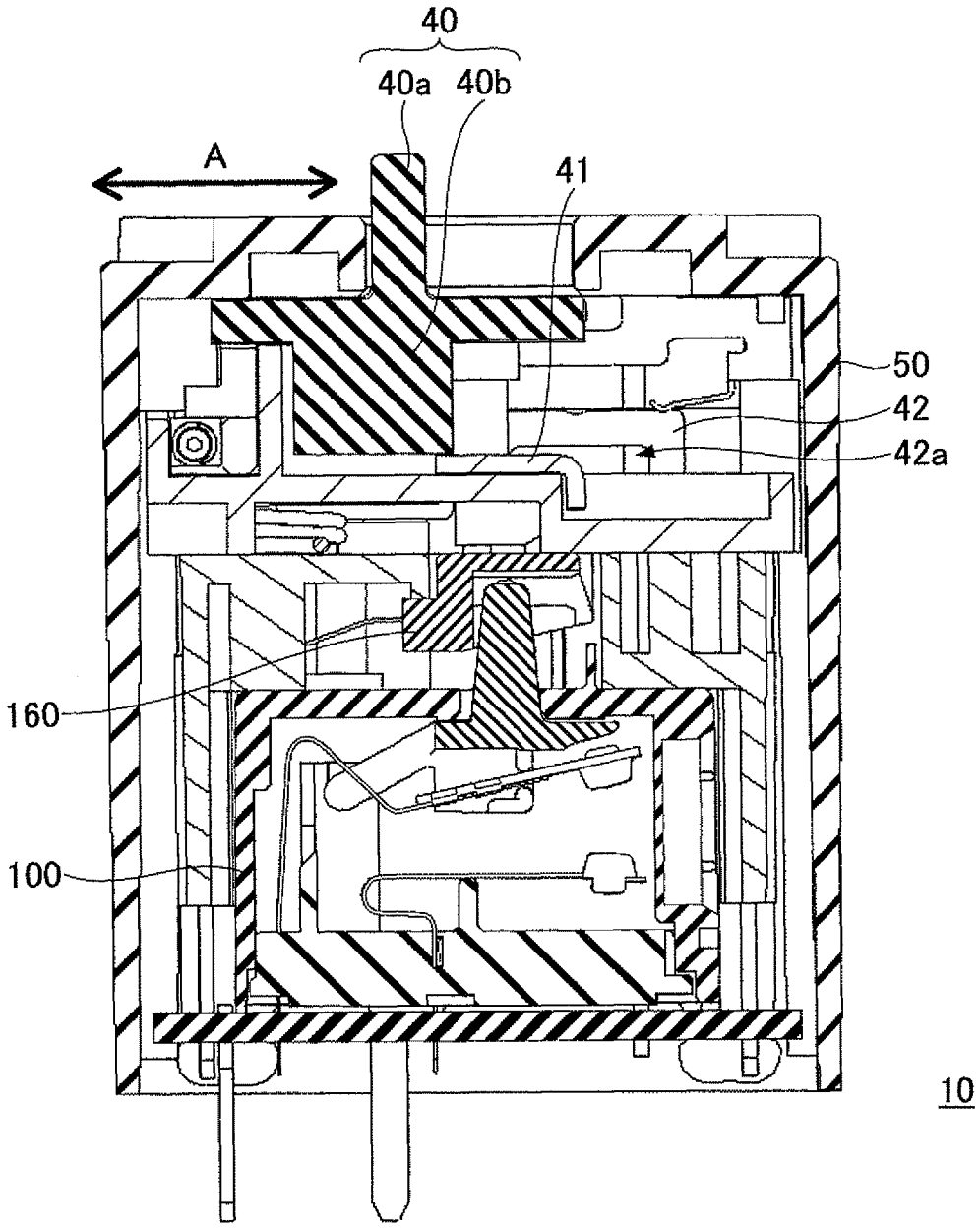
FIG. 9 is a cross-sectional view showing an example of the internal structure of the jack connector of the first embodiment.

The internal structure of the jack connector 10 of the embodiment is explained in detail with reference to FIG. 9. FIG. 9 is a cross-sectional view showing an example of the internal structure of the jack connector 10.

The jack connector 10 further includes a link portion 41, a contact slide portion 42, and a switch device 100.

The switch device 100 includes a button 160 that functions to switch on and off the electrical connection between the jack connector 10 and the plug connector 300, as will be explained later.

The operation unit 40 includes a sliding body portion 40*b* and an operational protruding portion 40*a* which is provided at an upper portion of the sliding body portion 40*b*. The operational protruding portion 40*a* protrudes outside the housing 50 from an opening provided at a top of the housing 50.

The jack connector 10 is configured such that when the operational protruding portion 40*a* of the operation unit 40 is moved in a direction shown by an arrow "A" (which will be referred to as a sliding direction), the switch device 100 is also operated to switch on and off the electrical connection between the jack connector 10 and the plug connector 300 (in other words, the electrical connection between the electric device and the power source).

The sliding body portion 40*b* is housed in the housing 50 and is connected to the link portion 41.

The contact slide portion 42 is provided with a slide opening 42*a* and a protruding contacting portion (not shown in the drawings). The protruding contacting portion is formed to extend in a direction (downward direction in FIG. 9) substantially perpendicular to the sliding direction. The protruding contacting portion of the contact slide portion 42 is provided to contact a top of the button 160 of the switch device 100 when the contact slide portion 42 is moved by the link portion 41.

The slide opening 42*a* is formed to extend in a direction substantially parallel to the sliding direction.

The link portion 41 is configured to be moved in a direction substantially parallel to the sliding direction. The link portion 41 is formed to have an "L" shape where one end of the "L" shape structure is inserted in the slide opening 42*a* of the contact slide portion 42 to be slidable within the slide opening 42*a* in the direction substantially perpendicular to the sliding direction.

The plug connector 300 and the jack connector 10 may be configured such that a hook (not shown in the drawings) of the jack connector 10 is fitted to the opening 312 of the plug connector 300 (see FIG. 4) when the operation unit 40 is operated to be positioned at the "ON" position and the electric power is supplied to the plug connector 300. Further, the plug connector 300 and the jack connector 10 may be configured such that the hook of the jack connector 10 is released from the opening 312 of the plug connector 300 when the operation unit 40 is operated to be positioned at the "OFF" position so that the plug connector 300 can be released from the jack connector 10. Further, the jack connector 10 may be configured such that the operation unit 40 cannot be moved to the "ON" position when the plug connector 300 is not physically connected to the jack connector 10, in other words, when the hook (not shown in the drawings) of the jack connector 10 is not fitted to the opening 312 of the plug connector 300.

(Switch Device)

The structure of the switch device 100 is now explained. The switch device 100 of the jack connector 10 functions to control supplying of the electric power from the power source. The switch device 100 may be referred to as a "power switch" as well.

Figure 10:
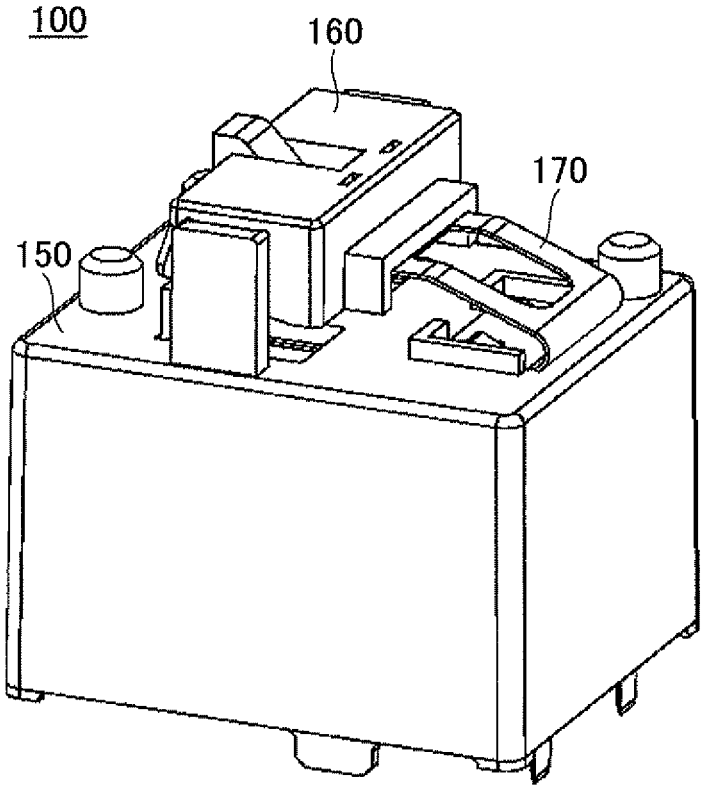
FIG. 10 is a perspective view of an example of a switch device of the first embodiment.
Figure 11:
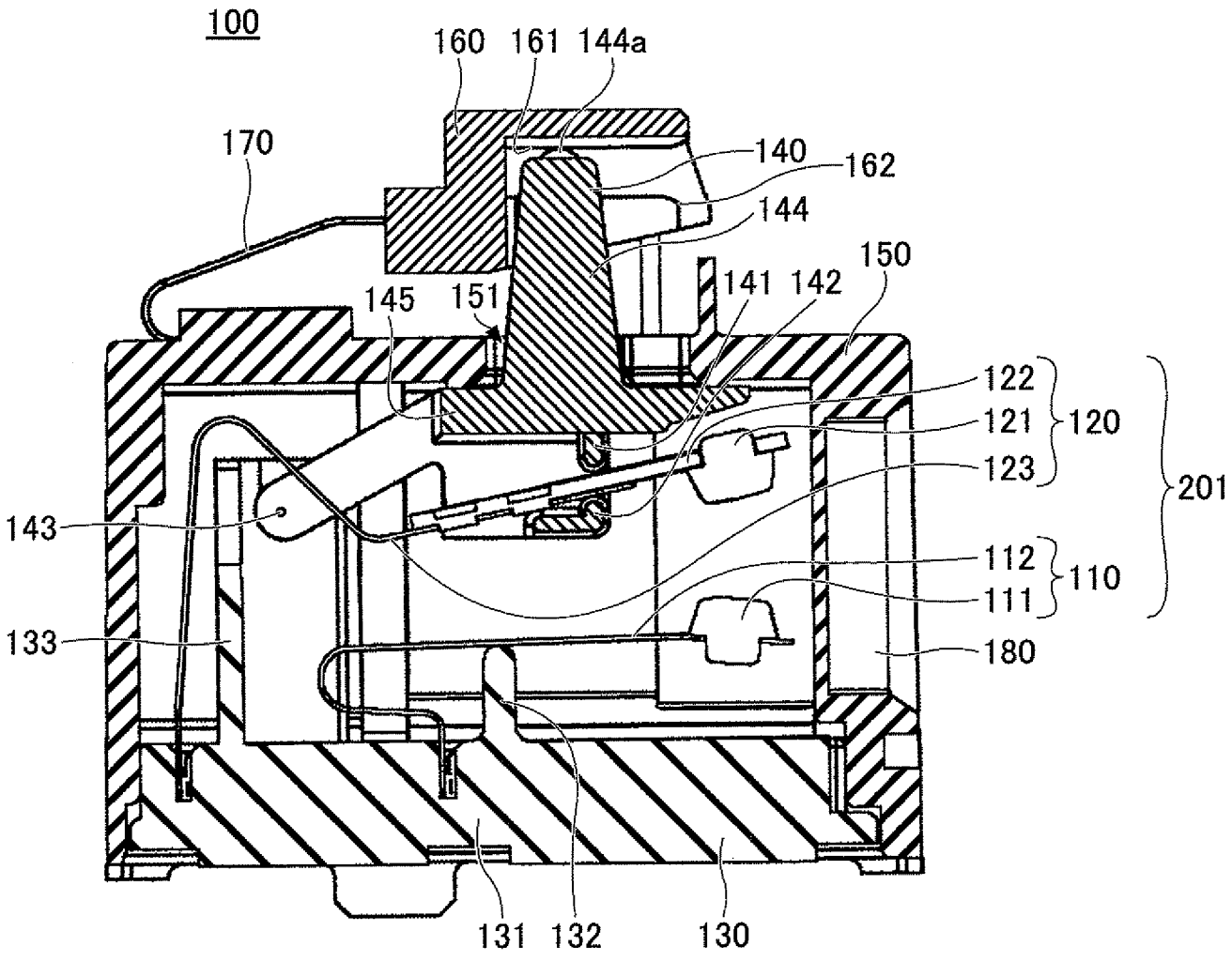
FIG. 11 is a cross-sectional view of an example of the switch device of the first embodiment.

FIG. 10 is a perspective view of an example of the switch device 100. FIG. 11 is a cross-sectional view of the switch device 100 showing an example of the internal structure of the switch device 100.

Referring to FIG. 11, the switch device 100 includes contacting portions 201 including fixed portions 110 and movable portions 120, a base block 130, a card member 140, a switch device housing 150, the button 160, a spring 170 and a magnet unit including permanent magnets 180.

Figure 13:
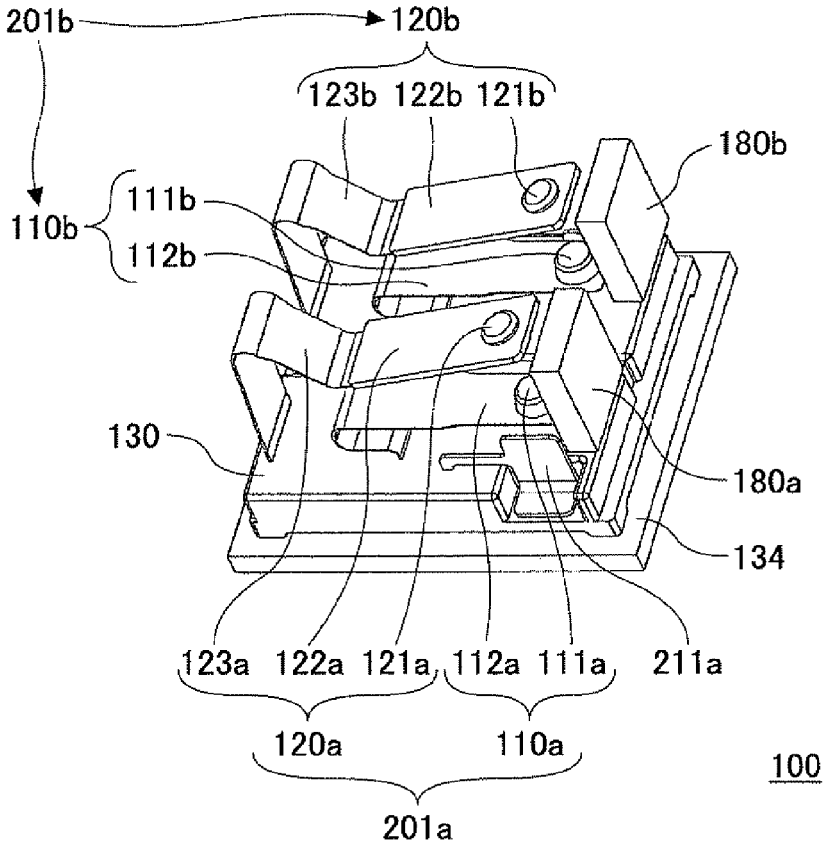
FIG. 13 is a perspective view of an example of the switch device of the first embodiment.
Figure 14:
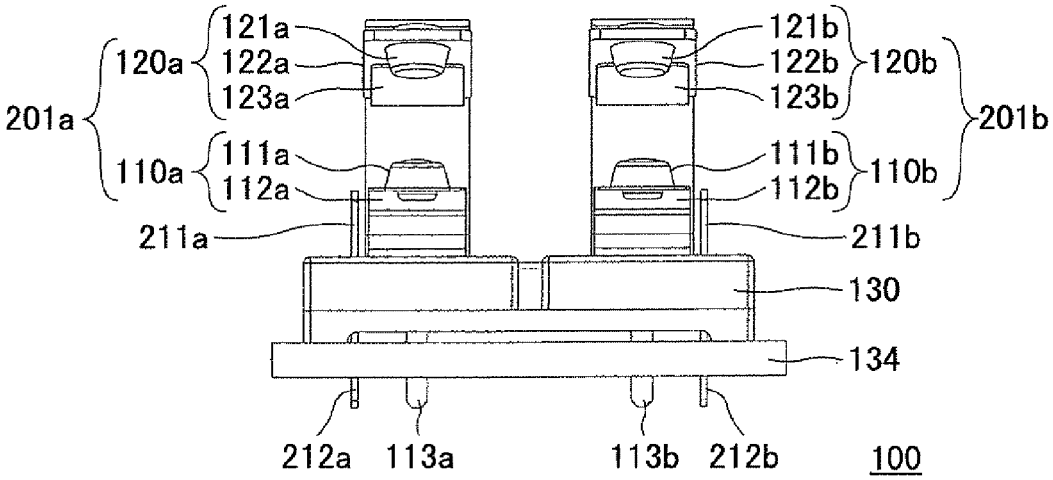
FIG. 14 is an elevation view of an example of the switch device of the first embodiment.

As will be explained later, the switch device 100 of the embodiment includes two of the contacting portions 201 each including the fixed portion 110 (a first fixed portion 110*a* or a second fixed portion 110*b*) and the movable portion 120 (a first movable portion 120*a* or a second movable portion 120*b*), and the permanent magnets 180 (a first permanent magnet 180*a* and a second permanent magnet 180*b*), although only one of each of them is shown in FIG. 10 and FIG. 11 (see also FIG. 13, FIG. 14 and the like).

The base block 130 includes a base block body portion 131, a fixed portion support portion 132 and an insulating wall 133. The insulating wall 133 may be made of fire-retardant resin or the like, for example.

The fixed portions 110 are made entirely of an electrical conductive material such as a metal or the like. Each of the fixed portions 110 includes a fixed spring 112 and a fixed contacting portion 111 provided at one end of the fixed spring 112. The fixed spring 112 may be formed by bending a metal plate or the like made of copper, an alloy including copper or the like, for example. The fixed contacting portion 111 may be made of an alloy including silver and copper, for example. Another end of the fixed spring 112 is fixed at the base block body portion 131 of the base block 130 and the middle part of the fixed spring 112 is supported by the fixed portion support portion 132 of the base block 130.

Similar to the fixed portions 110, the movable portions 120 are made entirely of an electrical conductive material such as a metal or the like. Each of the fixed portions 110 includes a movable plate portion 122, a movable spring 123 and a movable contacting portion 121. The movable contacting portion 121 is provided at one end of the movable plate portion 122 to correspond to the fixed contacting portion 111 of the fixed portions 110 to be contacted. One end of the movable spring 123 is connected to another end of the movable plate portion 122. The movable plate portion 122 and the movable spring 123 may be formed by bending a metal plate or the like made of copper, an alloy including copper or the like, for example. The movable contacting portion 121 may be made of an alloy including silver and copper, for example. Another end of the movable spring 123 is fixed in the base block body portion 131 of the base block 130. As the movable spring 123 is formed by bending the metal plate or the like, for example, the movable spring 123 has flexibility. Thus, the movable contacting portion 121 provided at the one end of the movable plate portion 122 is capable of being moved in an upward and downward direction.

The insulating wall 133 of the base block 130 is provided between a portion where the other end of the fixed spring 112 is fixed and a portion where the other end of the movable spring 123 is fixed. Thus, the movable spring 123 is bent to pass over the insulating wall 133 of the base block 130.

The switch device housing 150 is provided with a switch device opening 151 formed at its upper surface.

The card member 140 includes an upper contacting portion 141, a lower contacting portion 142, a rotating shaft 143, a protruding portion 144, a body portion 145, and a contacting portion 144*a* provided at upper portion of the protruding portion 144.

The card member 140, the base block 130 and the switch device housing 150 may be made of an insulating material such as resin or the like, respectively.

The upper contacting portion 141 of the card member 140 is provided to contact one surface (upper surface in FIG. 11) of the movable plate portion 122 of the movable portion 120, and the lower contacting portion 142 of the card member 140 is provided to contact the other surface (lower surface in FIG. 11) of the movable plate portion 122 of the movable portion 120. In other words, the movable plate portion 122 of the movable portion 120 is sandwiched by the upper contacting portion 141 and the lower contacting portion 142 of the card member 140. Further, the upper contacting portion 141 and the lower contacting portion 142 of the card member 140 are provided to slide on the one surface and the other surface of the movable plate portion 122, respectively. Thus, in order to reduce frictional resistance, the upper contacting portion 141 and the lower contacting portion 142 may be provided with surface layers made of fluorocarbon resin or the like at the surfaces, respectively.

Under this state, when the card member 140 is rotated around the rotating shaft 143, the force is applied to the movable plate portion 122 via the upper contacting portion 141 or the lower contacting portion 142 of the card member 140 so that the movable contacting portion 121 is moved downward or upward, respectively.

The fixed portions 110 and the movable portions 120 are provided within an area surrounded by the base block 130 and the switch device housing 150. The protruding portion 144 of the card member 140 is provided to protrude outside of the switch device housing 150 from the switch device opening 151 of the switch device housing 150. The body portion 145, the upper contacting portion 141 and the lower contacting portion 142 of the card member 140 are provided within an area surrounded by the base block 130 and the switch device housing 150.

The button 160 is provided outside the switch device housing 150 to push the protruding portion 144 of the card member 140 for rotating the card member 140 around the rotating shaft 143. The contacting portion 144*a* of the card member 140 contacts an inner wall portion 161 of the button 160. The contacting portion 144*a* of the card member 140 is provided to slide on a surface of the inner wall portion 161. Thus, in order to reduce frictional resistance, the inner wall portion 161 may be provided with a surface layer made of fluorocarbon resin or the like at the surface.

The spring 170 is provided outside the switch device housing 150. One end of the spring 170 is connected to the switch device housing 150 and the other end of the spring 170 is connected to the button 160.

The switch device 100 is configured to supply the electric power to the plug connector 300 when the fixed contacting portions 111 of the fixed portions 110 and the movable contacting portions 121 of the movable portions 120 are in contact, respectively, and terminate supplying of the electric power to the plug connector 300 when the fixed contacting portions 111 of the fixed portions 110 and the movable contacting portions 121 of the movable portions 120 are not in contact, respectively.

(ON and OFF Operation of Switch Device)

It is assumed that the plug connector 300 and the jack connector 10 are physically connected at this time. Then, when the operation unit 40 is operated to be positioned at the "ON" position, the sliding body portion 40*b* is moved in the sliding direction shown by the arrow "A" (see FIG. 9). With the movement of the body portion 40*b* of the operation unit 40, the link portion 41 is also moved in the sliding direction to move the contact slide portion 42 in the sliding direction as well. Thus, the protruding contacting portion (not shown in the drawings) of the contact slide portion 42 is positioned to push the button 160 of the switching portion downward.

With this operation, the contacting portion 141 of the card member 140 is pushed by the inner wall portion 161 of the button 160 so that the card member 140 is rotated around the rotating shaft 143.

Then, the force is applied to the movable plate portions 122 of the movable portions 120 through the upper contacting portion 141 of the card member 140 in a downward direction so that the movable contacting portions 121 and the fixed contacting portions 111 of the fixed portions 110 make contact, respectively.

Figure 12:
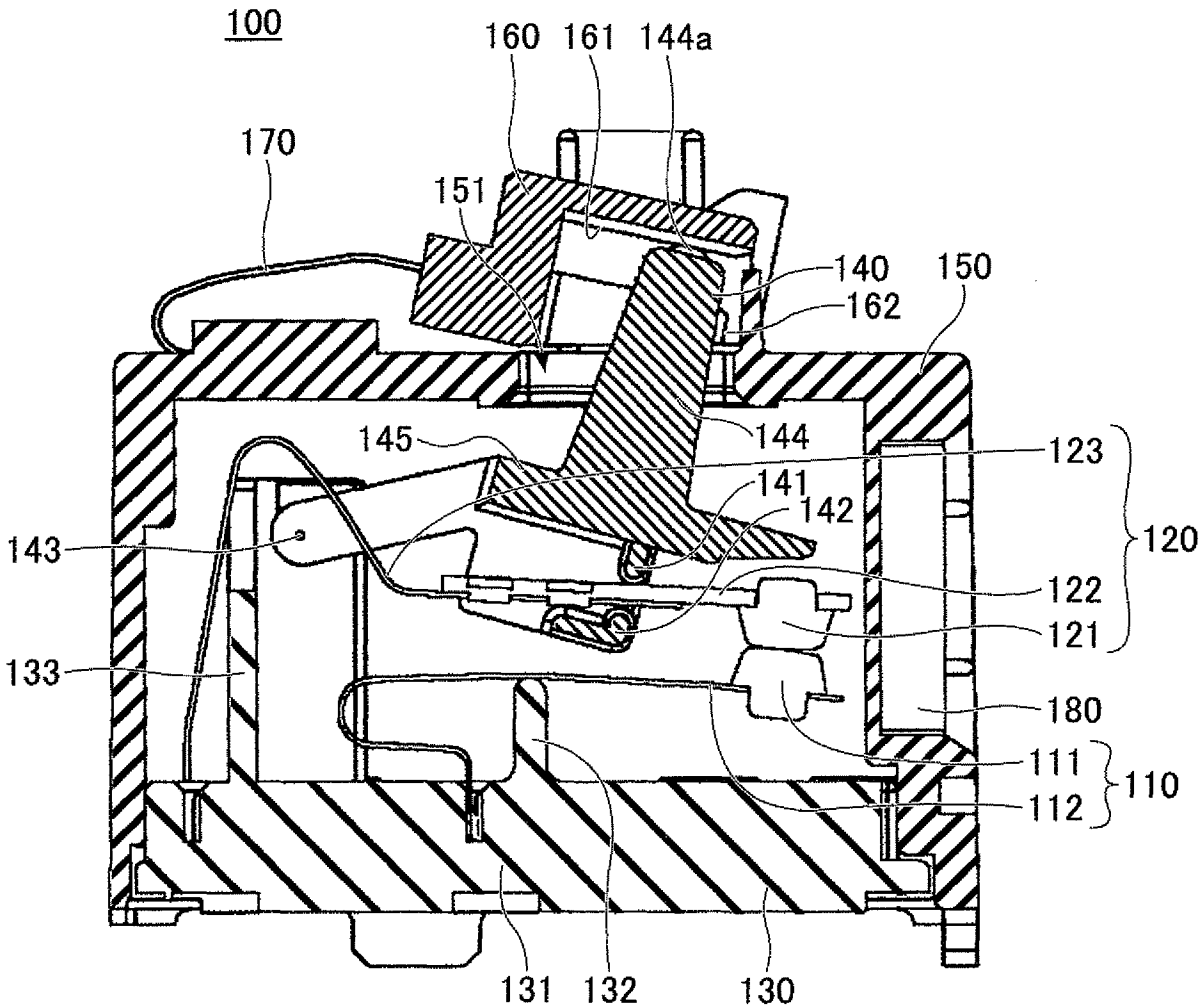
FIG. 12 is a cross-sectional view of an example of the switch device of the first embodiment.

FIG. 12 is a cross-sectional view of the switch device 100 when the fixed contacting portions 111 and the movable contacting portions 121 make contact, respectively.

Although not shown in the drawings, the contact slide portion 42 is configured to maintain this status while the operation unit 40 is positioned at the "ON" position. Thus, the movable contacting portions 121 and the fixed contacting portions 111 are in contact while the operation unit 40 is positioned at the "ON" position so that the electric power is supplied from the power source to the electric device.

Further, when the operation unit 40 is operated to be positioned at the "OFF" position, the contact slide portion 42 is released from pushing the button 160 so that the force applied to the button 160 is released. At this time, the button 160 is moved back in an upper direction by the spring force of the spring 170. With this operation, the card member 140 is rotated around the rotating shaft 143 in the upper direction so that the force in the upward direction is applied to the movable plate portions 122 of the movable portions 120 through the lower contacting portion 142 of the card member 140. Specifically, when the button 160 is moved back in the upper direction, a step portion 162 provided at an inside wall of the button 160 engages with a protruding portion (not shown in the drawings) provided at the card member 140 so that the card member 140 is moved with the button 160 to be rotated around the rotating shaft 143.

Then, the movable contacting portions 121 are moved upward to be apart from the corresponding fixed contacting portions 111 to terminate the supply of the electric power from the power source.

At this time, a case may occur where electric arcs are generated between the movable contacting portions 121 and the corresponding fixed contacting portions 111. Thus, according to the switch device 100 of the embodiment, the permanent magnets 180 are provided near contacting areas of the movable contacting portions 121 and the corresponding fixed contacting portions 111 to blow off the electric arcs by magnetic fields. The permanent magnets 180 are provided to generate the magnetic fields in a direction substantially perpendicular to a direction in which the electric arcs are generated.

Alternatively, electro-magnets may be used instead of the permanent magnets 180.

Further, in the switch device 100, the spring force of the spring 170, which is provided outside the switch device housing 150, is used to terminate supplying of the electric power from the power source, instead of using the resilience of the springs of the movable portions 120 such as the movable springs 123 or the like. Thus, even when the movable springs 123 of the movable portions 120 do not have the resilience, supplying of the power source can be terminated.

Here, there is a possibility that heat is generated inside the switch device housing 150 so that the fixed portions 110 and the movable portions 120 may be affected by the heat. However, as the spring 170 is provided outside the switch device housing 150, the spring 170 is not affected by the heat generated inside the switch device housing 150.

Therefore, even in a case when a part of the movable springs 123 or the like is melted by the heat generated inside the switch device housing 150, and the movable springs 123 or the like begin to not function as springs, supplying of the power source can be terminated by the spring force of the spring 170 without using the resilience of the movable springs 123 or the like.

It means that supplying of the electric power from the power source can be surely terminated.

Further, in the switch device 100, the insulating wall 133 is provided at the base block 130 between the portion where the other end of the fixed spring 112 is fixed and the portion where the other end of the movable spring 123 is fixed. With this structure, even when a part of the fixed portions 110 and the movable portions 120 is melted by the heat, the melted portion of the fixed portions 110 and melted portion of the movable portions 120 are separated by the insulating wall 133. Thus, a condition in which the melted portion of the fixed portions 110 and the melted portion of the movable portions 120 make contact so that the current of the power source continues to flow (short of the fixed portion 110 and the corresponding movable portion 120), can be prevented from occurring.

(Structure of Switch Device)

Figure 15:
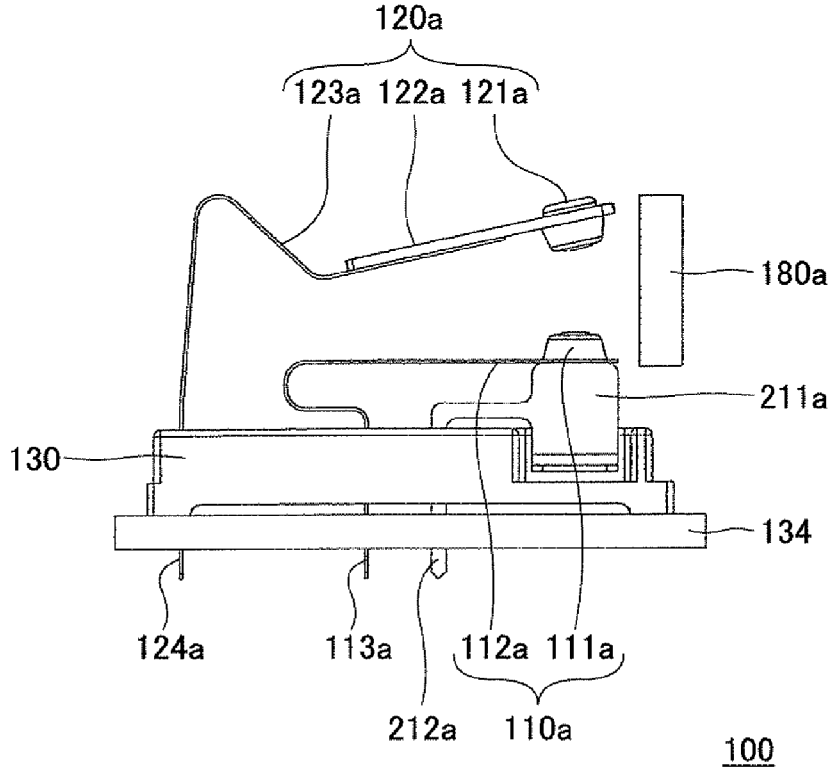
FIG. 15 is a side view of an example of the switch device of the first embodiment.

The switch device 100 of the embodiment is explained in detail. FIG. 13 is a perspective view of an example of the switch device 100, FIG. 14 is an elevation view of an example of the switch device 100, FIG. 15 is a side view of an example of the switch device 100, FIG. 16 is an elevation view of an example of the switch device 100 and FIG. 17 is a bottom view of an example of the switch device 100.

As shown in FIG. 13 to FIG. 16, the switch device 100 of the embodiment includes a first contacting portion 201*a* and a second contacting portion 201*b* corresponding to the switching portions 201, and a first permanent magnet 180*a* and a second permanent magnet 180*b* corresponding to the permanent magnets 180. The switch device 100 further includes a fixed portion external terminal 113*a*, a fixed portion external terminal 113*b*, a movable portion external terminal 124*a*, a movable portion external terminal 124*b*, a first fixed portion arc runner 211*a*, a second fixed portion arc runner 211*b*, fixed portion arc runner external terminals 212*a* and 212*b* and a printed circuit board 134. The first fixed portion arc runner 211*a* and the second fixed portion arc runner 211*b* are an example of a first electric arc runner and a second electric arc runner, respectively.

Figure 16:
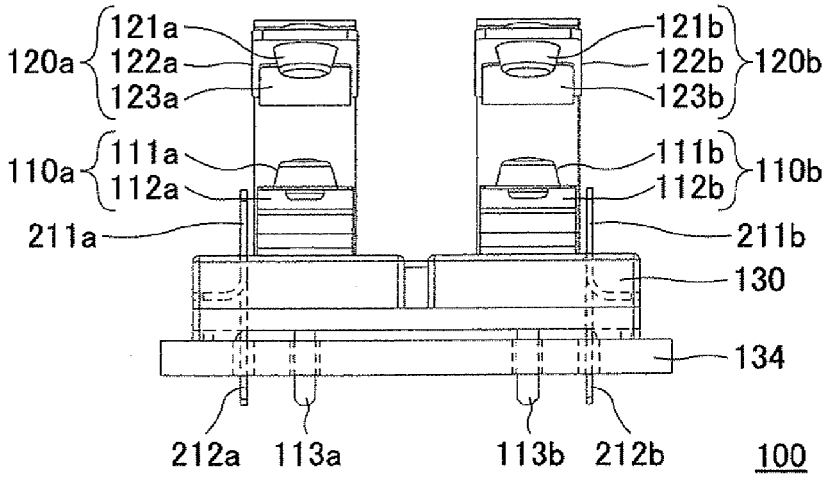
FIG. 16 is an elevation view of an example of the switch device of the first embodiment.
Figure 17:
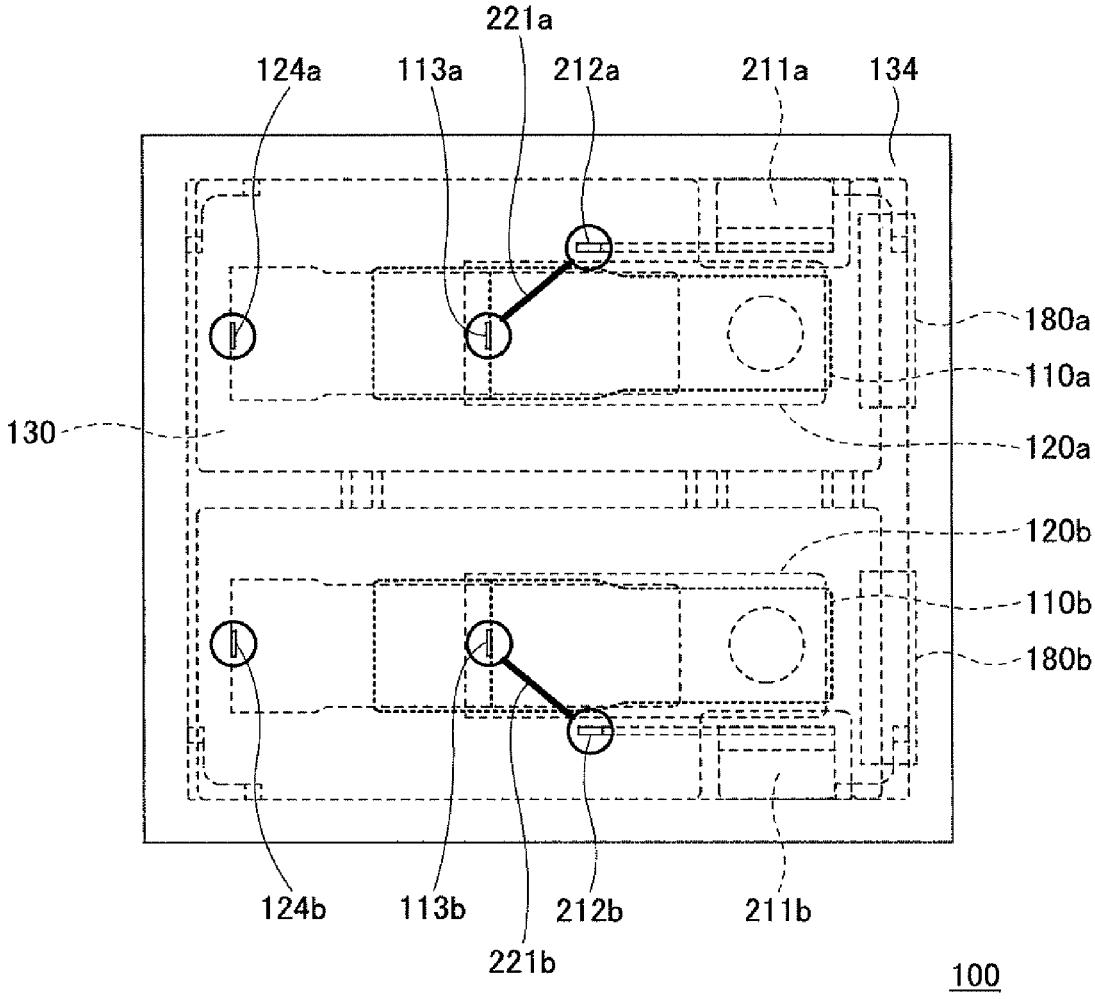
FIG. 17 is a bottom view of an example of the switch device of the first embodiment.

In FIG. 16, the fixed portion arc runner external terminals 212*a* and 212*b* and the fixed portion external terminals 113*a* and 113*b* are shown by dotted lines.

The first contacting portion 201*a* includes a first fixed portion 110*a* and a first movable portion 120*a*. The second contacting portion 201*b* includes a second fixed portion 110*b* and a second movable portion 120*b*. Here, the first fixed portion 110*a* and the second fixed portion 110*b* correspond to the fixed portions 110. The first movable portion 120*a* and the movable portion 120*b* correspond to the movable portions 120.

In the switch device 100 of the embodiment, the electric power from the power source can be supplied to the electronic device when both the first fixed portion 110*a* and the first movable portion 120*a* are in contact, and when the second fixed portion 110*b* and the second movable portion 120*b* are in contact.

The first fixed portion 110*a* includes a first fixed contacting portion 111*a* and a fixed spring 112*a* which is electrically connected to the fixed portion external terminal 113*a*. Similarly, the second fixed portion 110*b* includes a second fixed contacting portion 111*b* and a fixed spring 112*b* which is electrically connected to the fixed portion external terminal 113*b*. The first fixed contacting portion 111*a* and the second fixed contacting portion 111*b* correspond to the fixed contacting portions 111, and the fixed spring 112*a* and the fixed spring 112*b* correspond to the fixed springs 112.

The first movable portion 120*a* includes a first movable contacting portion 121*a*, a movable plate portion 122*a* and a movable spring 123*a* which is electrically connected to the movable portion external terminal 124*a*. Similarly, the second movable portion 120*b* includes a second movable contacting portion 121*b* and a movable plate portion 122*b* which is electrically connected to the movable portion external terminal 124*b*. The first movable contacting portion 121*a* and the second movable contacting portion 121*b* correspond to the movable contacting portions 121, the movable plate portion 122*a* and the movable plate portion 122*b* correspond to the movable plate portions 122, and the movable spring 123*a* and the movable spring 123*b* correspond to the movable springs 123.

The first fixed portion arc runner 211*a* and the second fixed portion arc runner 211*b* have functions to attract arc discharges generated between the first fixed contacting portion 111*a* and the first movable contacting portion 121*a*, and between the second fixed contacting portion 111*b* and the second movable contacting portion 121*b*, respectively.

The first fixed portion arc runner 211*a* and the second fixed portion arc runner 211*b* are provided to extend at sides of the first fixed contacting portion 111*a* and the second fixed contacting portion 111*b*, respectively. Specifically, the first fixed portion arc runner 211*a* has a substantially flat surface extending in a direction parallel to a moving direction of the first movable contacting portion 121*a* (upward and downward direction in FIG. 14, for example). Similarly, the second fixed portion arc runner 211*b* has a substantially flat surface extending in a direction parallel to a moving direction of the second movable contacting portion 121*b* (upward and downward direction in FIG. 14, for example).

As shown in FIG. 16, the fixed portion arc runner external terminal 212*a* is connected to the first fixed portion arc runner 211*a*, and the fixed portion arc runner external terminal 212*b* is connected to the second fixed portion arc runner 211*b*.

In this embodiment, the fixed portion external terminal 113*a* and the fixed portion arc runner external terminal 212*a* are electrically connected with each other, and the fixed portion external terminal 113*b* and the fixed portion arc runner external terminal 212*b* are electrically connected with each other. The fixed portion external terminal 113*a* and the fixed portion arc runner external terminal 212*a*, and the fixed portion external terminal 113*b* and the fixed portion arc runner external terminal 212*b* may be respectively connected with each other by wirings (not shown in the drawings) included in the printed circuit board 134.

Alternatively, as shown in FIG. 17, the fixed portion external terminal 113*a* and the fixed portion arc runner external terminal 212*a* may be connected by a wiring 221*a* such as a lead wire or the like, and the fixed portion external terminal 113*b* and the fixed portion arc runner external terminal 212*b* may be connected by a wiring 221*b* such as a lead wire or the like.

Further, alternatively, the first fixed portion arc runner 211*a* and the first fixed contacting portion 111*a*, and the second fixed portion arc runner 211*b* and the second fixed contacting portion 111*b* may be integrally formed to be connected, or the first fixed portion arc runner 211*a* and the first fixed contacting portion 111*a*, and the second fixed portion arc runner 211*b* and the second fixed contacting portion 111*b* may be connected by melting materials composing them by laser or the like to be connected, respectively.

Figure 39:
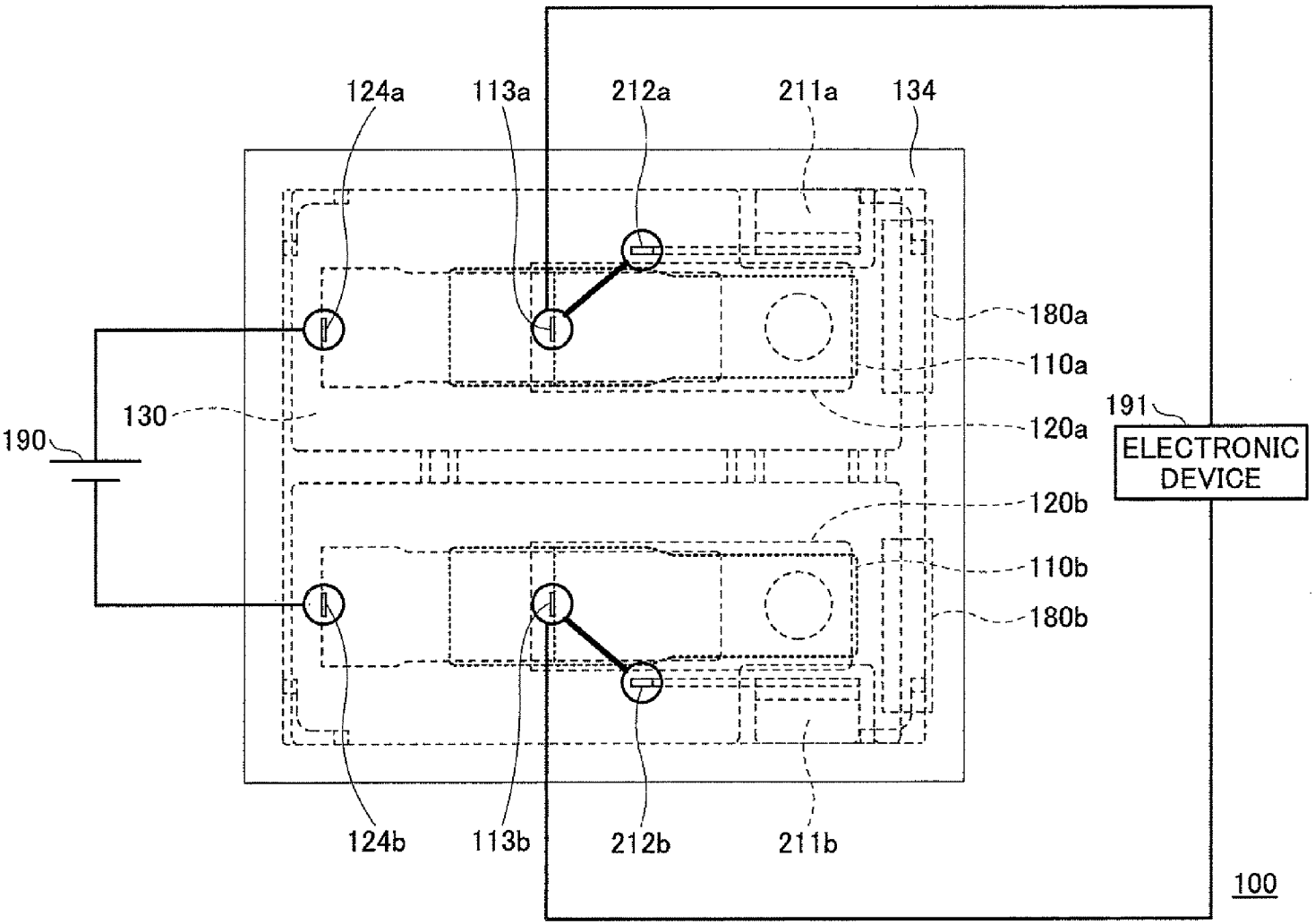
FIG. 39 is a bottom schematic view of an example of the switch device of the first embodiment.

FIG. 39 is a schematic view showing an example of the switch device 100 of the embodiment, a power source 190 and an electronic device 191.

The cathode of the power source 190 is electrically connected to the movable portion external terminal 124*a*, and the anode of the power source 190 is electrically connected to the movable portion external terminal 124*b*, in this embodiment.

Further, the fixed portion external terminal 113*a* is electrically connected to one of the terminals of the electronic device 191 to which the electric power is to be supplied, and the fixed portion external terminal 113*b* is electrically connected to the other of the terminals of the electronic device 191. As described above, in this embodiment, the switch device 100 of the jack connector 10 is electrically connected to the electric device 191 via the plug connector 300, although the plug connector 300 is not shown in FIG. 39.

The first permanent magnet 180*a* is provided to correspond to the first fixed portion 110*a* and the first movable portion 120*a*. The first permanent magnet 180*a* has a function to blow off an electric arc generated between the first fixed contacting portion 111*a* and the first movable contacting portion 121*a* by a magnetic field.

Similarly, the second permanent magnet 180*b* is provided to correspond to the second fixed portion 110*b* and the second movable portion 120*b*. The second permanent magnet 180*b* has a function to blow off an electric arc generated between the second fixed contacting portion 111*b* and the second movable contacting portion 121*b* by a magnetic field.

In this embodiment, the first permanent magnet 180*a* and the second permanent magnet 180*b* are provided such that the directions to blow off the electric arcs generated between the first fixed contacting portion 111*a* and the first movable contacting portion 121*a*, and between the second fixed contacting portion 111*b* and the second movable contacting portion 121*b* become opposite from each other. Specifically, the first permanent magnet 180*a* may be provided such that the electric arc generated between the first fixed contacting portion 111*a* and the first movable contacting portion 121*a* is blown off in an outward direction (a direction opposite to the second contacting portion 201*b*). Similarly, the second permanent magnet 181*b* may be provided such that the electric arc generated between the second fixed contacting portion 111*b* and the second movable contacting portion 121*b* is blown off in an outward direction (a direction opposite to the first contacting portion 201*a*).

Thus, in this embodiment, the first permanent magnet 180*a* and the second permanent magnet 180*b* are provided to generate magnetic fields in the same directions as the current flows between the first fixed contacting portion 111*a* and the first movable contacting portion 121*a*, and between the second fixed contacting portion 111*b* and the second movable contacting portion 121*b*, respectively; that is, in different directions. Specifically, the first permanent magnet 180*a* is placed such that the South Pole faces the side where the first fixed contacting portion 111*a* and the first movable contacting portion 121*a* are provided. Similarly, the second permanent magnet 180*b* is placed such that the South Pole faces the side where the second fixed contacting portion 111*b* and the second movable contacting portion 121*b* are provided.

With this structure, the magnetic field by the first permanent magnet 180*a* is generated between the first fixed contacting portion 111*a* and the first movable contacting portion 121*a*, and the magnetic field by the second permanent magnet 180*b* is generated between the second fixed contacting portion 111*b* and the second movable contacting portion 121*b*. Alternatively, instead of the first permanent magnet 180*a* and the second permanent magnet 180*b*, electro-magnets may be used.

Under a state where the power source 190 and the electronic device 191 are electrically connected, in other words, both the first fixed contacting portion 111*a* and the first movable contacting portion 121*a* are electrically connected, and the second fixed contacting portion 111*b* and the second movable contacting portion 121*b* are electrically connected, a current is supplied from the cathode of the power source 190 to the movable portion external terminal 124*a*. Then, the current flows through the first movable portion 120*a*, the first fixed portion 110*a* via the first movable contacting portion 121*a* and the first fixed contacting portion 111*a* and the fixed portion external terminal 113*a* in this order to be supplied to the electronic device 191. Then, the current further flows from the electronic device 191 through the fixed portion external terminal 113*b*, the second fixed portion 110*b*, the second movable portion 120*b* via the second fixed contacting portion 111*b* and the second movable contacting portion 121*b*, and the movable portion external terminal 124*b* in this order to reach the anode of the power source 190.

Thereafter, when the first fixed contacting portion 111*a* and the first movable contacting portion 121*a* become disconnected, and/or the second fixed contacting portion 111*b* and the second movable contacting portion 121*b* become disconnected, supplying of the electric power from the power source 190 to the electronic device 191 is stopped.

At this time, arc discharges may be generated between the first fixed contacting portion 111*a* and the first movable contacting portion 121*a*, and between the second fixed contacting portion 111*b* and the second movable contacting portion 121*b*.

However, in the switch device 100 of the embodiment, as the first fixed portion arc runner 211*a* and the second fixed portion arc runner 211*b* are provided, even when the arc discharges are generated, the arc discharges can be attracted to the first fixed portion arc runner 211*a* from the first fixed contacting portion 111*a*, or to the second fixed portion arc runner 211*b* from the second fixed contacting portion 111*b*. Here, as the structure of the first fixed portion arc runner 211*a* and the second fixed portion arc runner 211*b* can be freely set, for example, the first fixed portion arc runner 211*a* and the second fixed portion arc runner 211*b* may be formed as explained above to have a sufficient thickness in order to prevent ablation or the like. Therefore, ablation of the first fixed portion arc runner 211*a* and the second fixed portion arc runner 211*b* can be prevented even when the arc discharges are attracted to the first fixed portion arc runner 211*a* and the second fixed portion arc runner 211*b*.

Thus, damage caused by the arc discharges at the first fixed contacting portion 111*a* and the second fixed contacting portion 111*b* can be reduced. In other words, it is possible to generate the arc discharges between the first movable contacting portion 121*a* and the first fixed portion arc runner 211*a*, and between the second movable contacting portion 121*b* and the second fixed portion arc runner 211*b*. Thus, the damage to the first fixed contacting portion 111*a* and the fixed contacting portion second 111*b* caused by the arc discharges can be reduced.

In this embodiment, the first fixed portion arc runner 211*a* and the second fixed portion arc runner 211*b* may be formed by bending a plate or the like. Further, the first fixed portion arc runner 211*a* and the second fixed portion arc runner 211*b* may respectively be formed to have a sufficient thickness in order to prevent ablation or the like. Further, the first fixed portion arc runner 211*a* and the second fixed portion arc runner 211*b* may respectively be made of an electrical conductive material such as a metal or an alloy including copper or the like, for example.

By providing the first fixed portion arc runner 211*a* and the second fixed portion arc runner 211*b*, damage to the first fixed contacting portion 111*a* and the second fixed contacting portion 111*b* can be reduced so that durability and reliability of the first fixed contacting portion 111*a* and the second fixed contacting portion 111*b* can be improved. Thus, durability and reliability of the switch device 100 and the jack connector 10 can also be improved.

Figure 18:
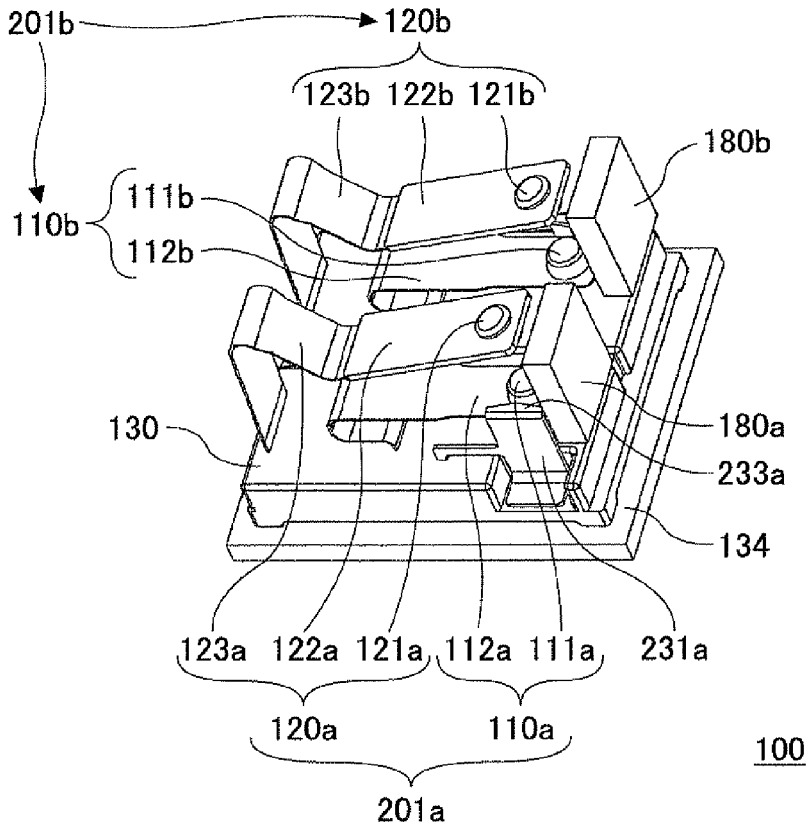
FIG. 18 is a perspective view of another example of the switch device of the first embodiment.
Figure 19:
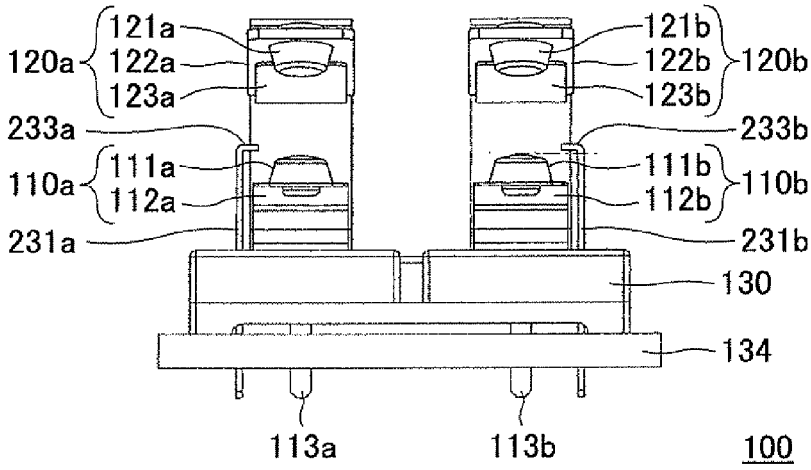
FIG. 19 is an elevation view of another example of the switch device of the first embodiment.
Figure 20:
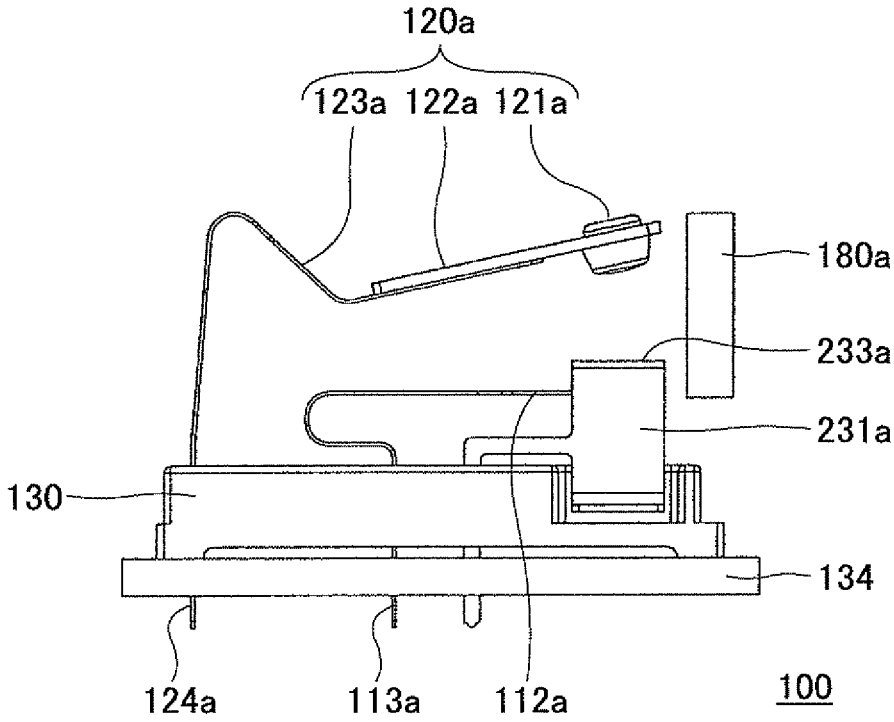
FIG. 20 is a side view of another example of the switch device of the first embodiment.
Figure 21:
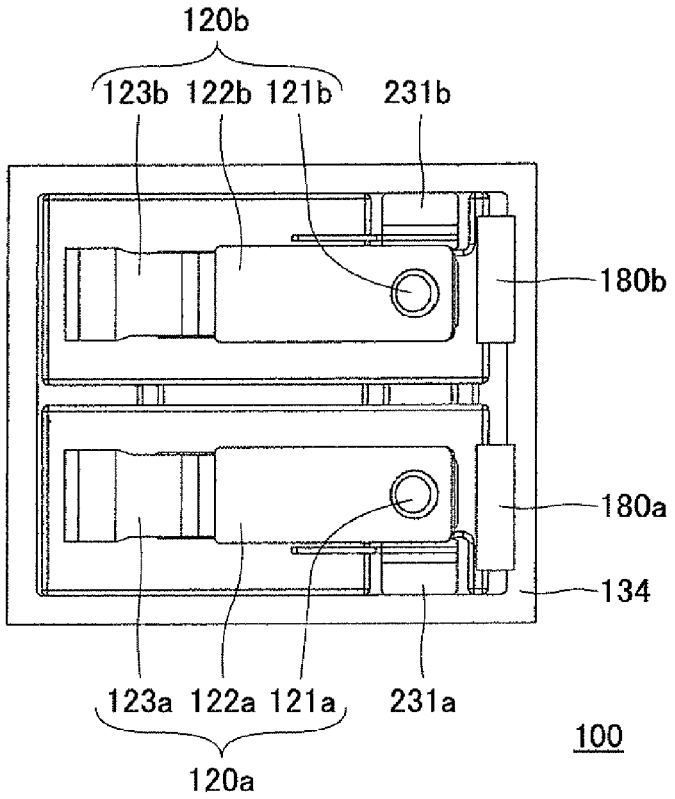
FIG. 21 is a top view of another example of the switch device of the first embodiment.
Figure 22:
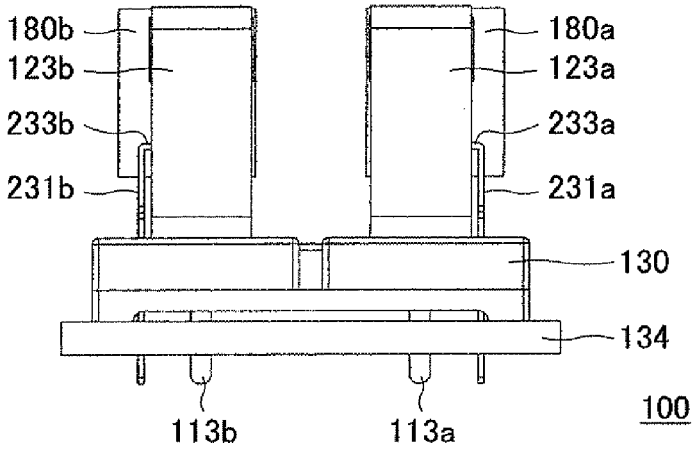
FIG. 22 is a back side view of another example of the switch device of the first embodiment.

FIG. 18 to FIG. 22 show another example of the first fixed portion arc runner and the second fixed portion arc runner of the first embodiment. FIG. 18 is a perspective view of another example of the switch device 100, FIG. 19 is an elevation view of another example of the switch device 100, FIG. 20 is a side view of another example of the switch device 100, FIG. 21 is a top view of another example of the switch device 100 and FIG. 22 is a back side view of another example of the switch device 100.

In this example, structures of the first fixed portion arc runner and the second fixed portion arc runner are different from those of the first fixed portion arc runner 211*a* and the second fixed portion arc runner 211*b* shown in FIG. 13 to FIG. 17.

As shown in FIG. 18 to FIG. 22, the switch device 100 of the example includes a first fixed portion arc runner 231*a* and a second fixed portion arc runner 231*b* instead of the first fixed portion arc runner 211*a* and the second fixed portion arc runner 211*b*.

The first fixed portion arc runner 231*a* is provided with a bending portion 233*a* formed by bending the upper end portion of the first fixed portion arc runner 231*a* toward the first fixed contacting portion 111*a* to have a reversed "L" shape. Similarly, the second fixed portion arc runner 231*b* is provided with a bending portion 233*b* formed by bending the upper end portion of the second fixed portion arc runner 231*b* toward the second fixed contacting portion 111*b* to have a reversed "L" shape.

Figure 23:
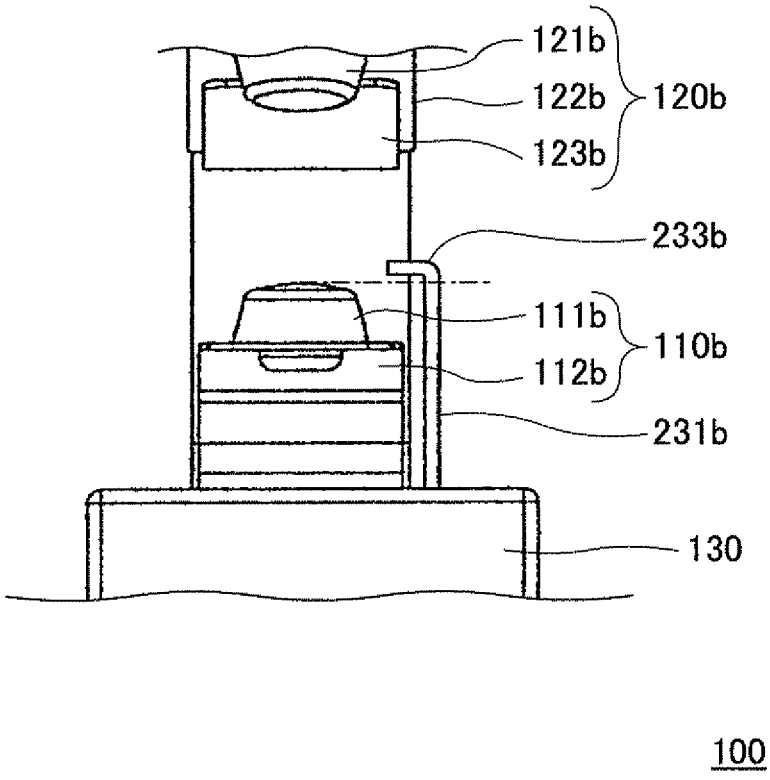
FIG. 23 is an enlarged elevation view of another example of the switch device of the first embodiment.

FIG. 23 is an enlarged elevation view of the switch device 100 showing the second fixed portion arc runner 231*b*. As shown in FIG. 23, the first fixed portion arc runner 231*a* and the second fixed portion arc runner 231*b* may be configured such that the bending portions 233*a* and 233*b* are positioned at positions higher than those of upper ends of the first fixed contacting portion 111*a* and the second fixed contacting portion 111*b*, respectively.

In other words, the bending portion 233*a* of the first fixed portion arc runner 231*a* may be provided to be positioned at a height between the first movable contacting portion 121*a* and the first fixed contacting portion 111*a* when the first movable contacting portion 121*a* is not in contact with the first fixed contacting portion 111*a*. Further, the first fixed portion arc runner 231*a* is configured to be positioned such that the distance between the first fixed portion arc runner 231*a* and the first movable contacting portion 121*a* is shorter than the distance between the first fixed contacting portion 111*a* and the first movable contacting portion 121*a* when the first movable contacting portion 121*a* takes a position as shown in FIG. 11 where the operation unit 40 is positioned at the "OFF" position (see FIG. 9).

Similarly, the bending portion 233*b* of the second fixed portion arc runner 231*b* may be formed to be positioned at a height between the second movable contacting portion 121*b* and the second fixed contacting portion 111*b* when the second movable contacting portion 121*b* is not in contact with the second fixed contacting portion 111*b*. Further, the second fixed portion arc runner 231*b* is configured to be positioned such that the distance between the second fixed portion arc runner 231*b* and the second movable contacting portion 121*b* is shorter than the distance between the second fixed contacting portion 111*b* and the second movable contacting portion 121*b* when the second movable contacting portion 121*b* takes a position as shown in FIG. 11 where the operation unit 40 is positioned at the "OFF" position (see FIG. 9).

By thus forming the first fixed portion arc runner 231*a*, the arc discharge tends to be generated between the first movable contacting portion 121*a* and the bending portion 233*a* of the first fixed portion arc runner 231*a* rather than between the first movable contacting portion 121*a* and the first fixed contacting portion 111*a*. Similarly, by thus forming the second fixed portion arc runner 231*b*, the arc discharge tends to be generated between the second movable contacting portion 121*b* and the bending portion 233*b* of the second fixed portion arc runner 231*b* rather than between the second movable contacting portion 121*b* and the second fixed contacting portion 111*b*. Thus, damage to the first fixed contacting portion 111*a* and the second fixed contacting portion 111*b* can further be reduced so that durability and reliability of the first fixed contacting portion 111*a* and the second fixed contacting portion 111*b* can further be improved. Therefore, durability and reliability of the switch device 100 and the jack connector 10 can also be improved.

Second Embodiment

Figure 24:
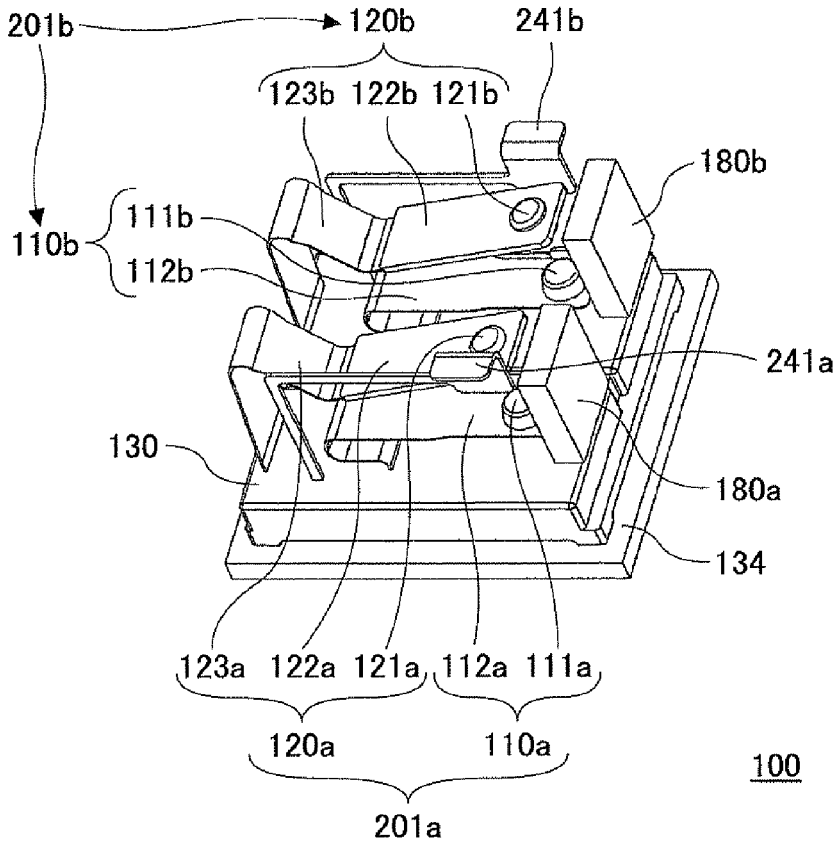
FIG. 24 is a perspective view of an example of the switch device of a second embodiment.
Figure 25:
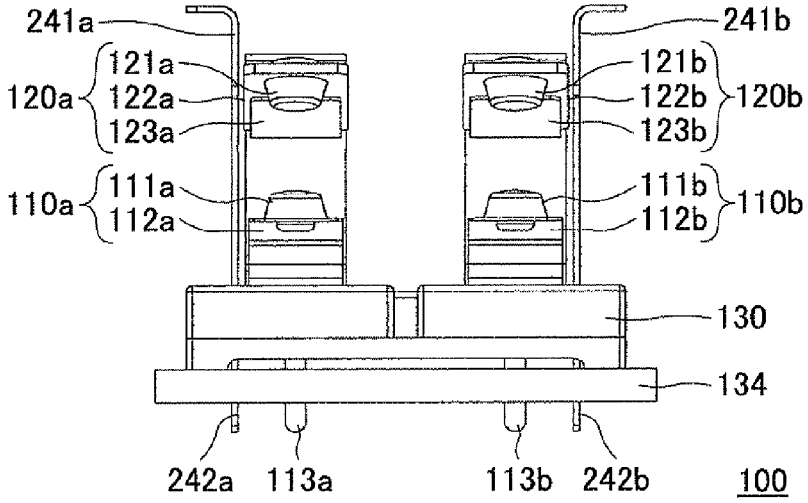
FIG. 25 is an elevation view of an example of the switch device of the second embodiment.
Figure 26:
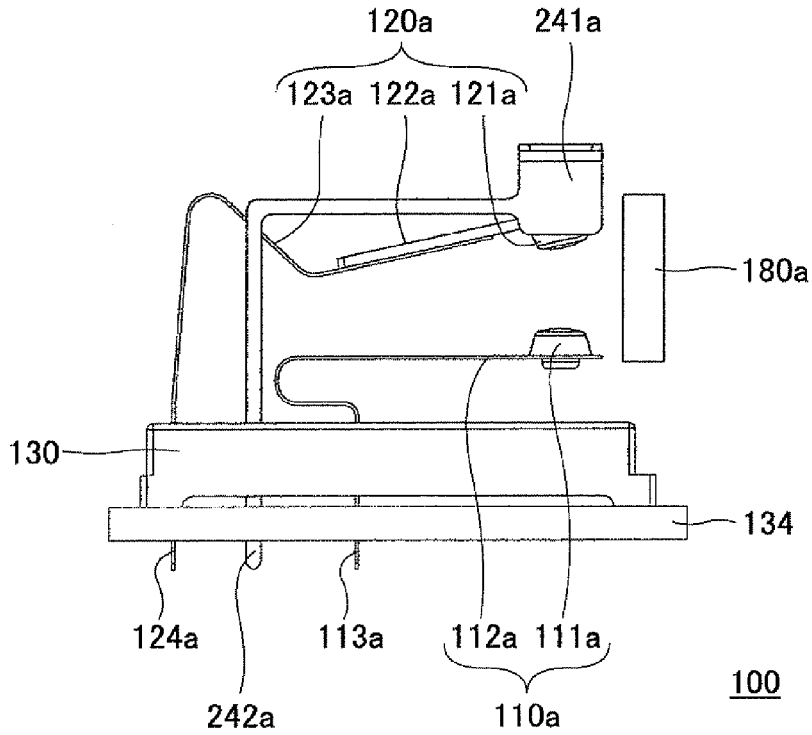
FIG. 26 is a side view of an example of the switch device of the second embodiment.
Figure 27:
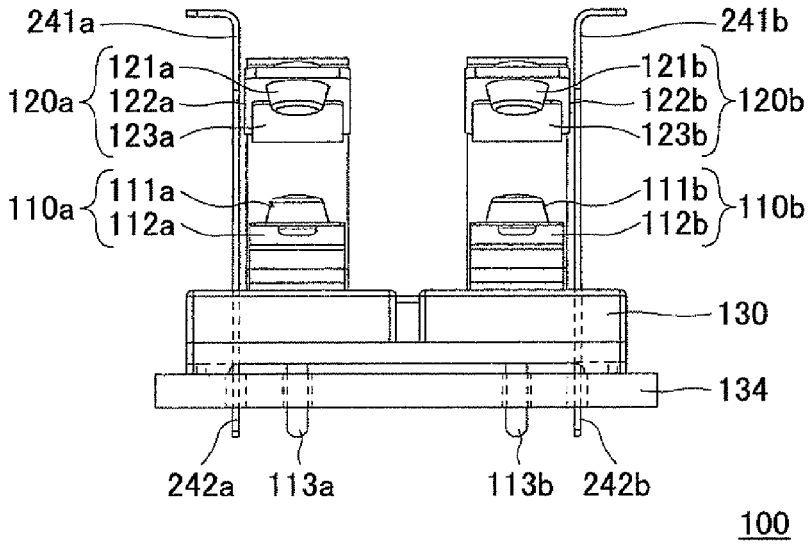
FIG. 27 is an elevation view of an example of the switch device of the second embodiment.
Figure 28:
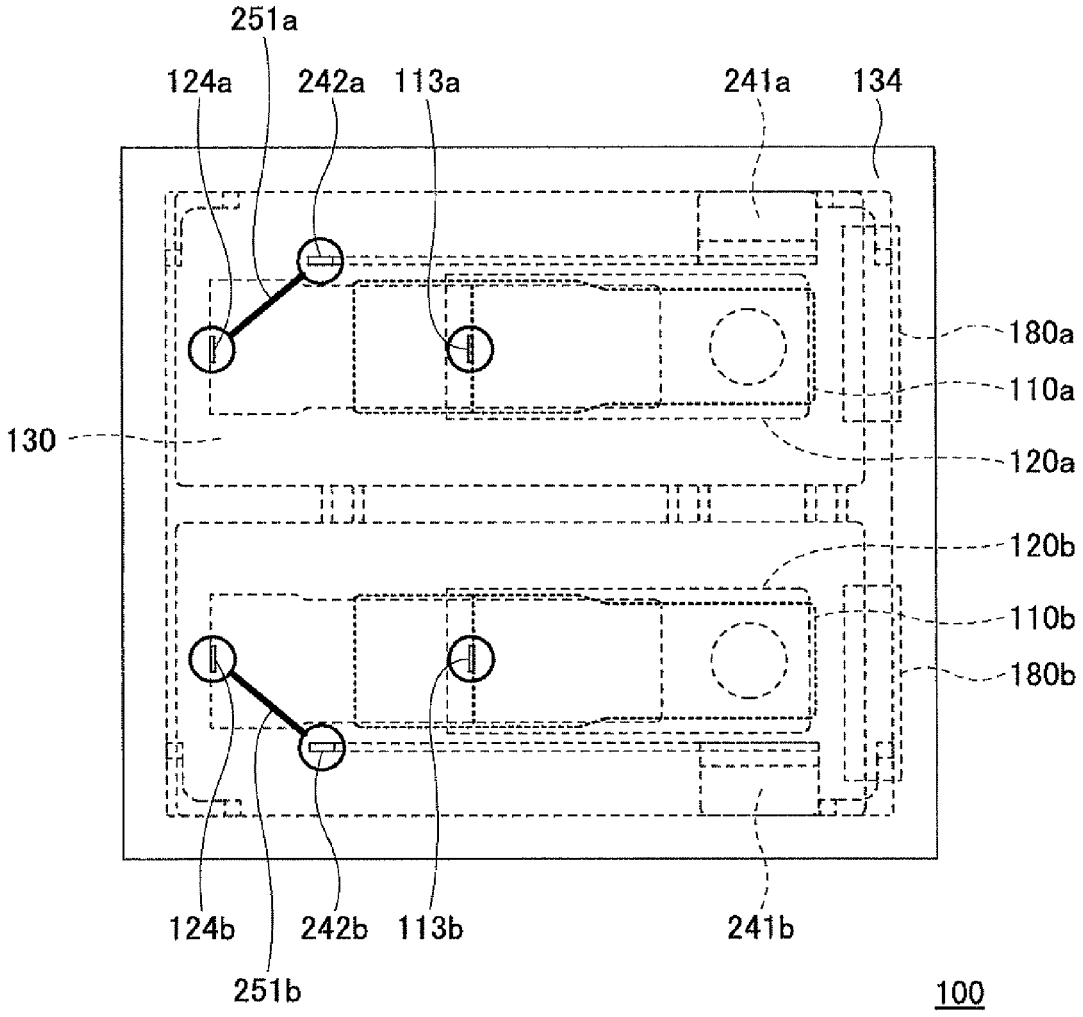
FIG. 28 is a bottom view of an example of the switch device of the second embodiment.

The switch device 100 of the second embodiment is explained with reference to FIG. 24 to FIG. 28. FIG. 24 is a perspective view of an example of the switch device 100, FIG. 25 is an elevation view of an example of the switch device 100, FIG. 26 is a side view of an example of the switch device 100, FIG. 27 is an elevation view of an example of the switch device 100 and FIG. 28 is a bottom view of an example of the switch device 100, of the second embodiment.

In this embodiment, the switch device 100 includes a first movable portion arc runner 241*a* and a second movable portion arc runner 241*b* instead of the first fixed portion arc runner and the second fixed portion arc runner of the first embodiment. The first movable portion arc runner 241*a* and the second movable portion arc runner 241*b* are an example of a first electric arc runner and a second electric arc runner, respectively.

The first movable portion arc runner 241*a* and the second movable portion arc runner 241*b* have functions to attract arc discharges generated between the first fixed contacting portion 111*a* and the first movable contacting portion 121*a*, and between the second fixed contacting portion 111*b* and the second movable contacting portion 121*b*, respectively.

The first movable portion arc runner 241*a* and the second movable portion arc runner 241*b* are provided to extend at sides of the first movable contacting portion 121*a* and the second movable contacting portion 121*b*, respectively. Specifically, the first movable portion arc runner 241*a* has a substantially flat surface extending in a direction parallel to a moving direction of the first movable contacting portion 121*a* (upward and downward direction in FIG. 14, for example). Similarly, the second movable portion arc runner 241*b* has a substantially flat surface extending in a direction parallel to a moving direction of the second movable contacting portion 121*b* (upward and downward direction in FIG. 14, for example).

The switch device 100 of the second embodiment further includes a movable portion arc runner external terminal 242*a* and a movable portion arc runner external terminal 242*b* respectively connected to the first movable portion arc runner 241*a* and the second movable portion arc runner 241*b*.

In this embodiment, the movable portion external terminal 124*a* and the movable portion arc runner external terminal 242*a* are electrically connected with each other, and the movable portion external terminal 124*b* and the movable portion arc runner external terminal 242*b* are also electrically connected with each other. The movable portion external terminal 124*a* and the movable portion arc runner external terminal 242*a*, and the movable portion external terminal 124*b* and the movable portion arc runner external terminal 242*b* may be respectively connected with each other by wirings (not shown in the drawings) included in the printed circuit board 134.

Alternatively, as shown in FIG. 28, the movable portion external terminal 124*a* and the movable portion arc runner external terminal 242*a* may be connected by a wiring 251*a* such as a lead wire or the like, and the movable portion external terminal 124*b* and the movable portion arc runner external terminal 242*b* may be connected by a wiring 251*b* such as a lead wire or the like.

Further, alternatively, the first movable portion arc runner 241*a* and the first movable contacting portion 121*a*, and the second movable portion arc runner 241*b* and the second movable contacting portion 121*b* may be integrally formed to be connected, or the first movable portion arc runner 241*a* and the first movable contacting portion 121*a*, and the second movable portion arc runner 241*b* and the second movable contacting portion 121*b* may be connected by melting materials composing them by laser or the like to be connected, respectively.

When the first fixed contacting portion 111*a* and the first movable contacting portion 121*a* become disconnected, and/or the second fixed contacting portion 111*b* and the second movable contacting portion 121*b* become disconnected, supplying of the electric power from the power source 190 to the electronic device 191 (see FIG. 39) is stopped. At this time, arc discharges may be generated between the first fixed contacting portion 111*a* and the first movable contacting portion 121*a*, and between the second fixed contacting portion 111*b* and the second movable contacting portion 121*b*.

However, in the switch device 100 of the embodiment, as the first movable portion arc runner 241*a* and the second movable portion arc runner 241*b* are provided, even when the arc discharges are generated, the arc discharges can be attracted to the first movable portion arc runner 241*a* from the first movable contacting portion 121*a* or to the second movable portion arc runner 241*b* from the second movable contacting portion 121*b*. Thus, damage caused by the arc discharge at the first movable contacting portion 121*a* and the second movable contacting portion 121*b* can be reduced. In other words, it is possible to generate the arc discharges between the first fixed contacting portion 111*a* and the first movable portion arc runner 241*a*, and between the second fixed contacting portion 111*b* and the second movable portion arc runner 241*b*. Thus, the damage to the first movable contacting portion 121*a* and the second movable contacting portion 121*b* caused by the arc discharges can be reduced.

In this embodiment, the first movable portion arc runner 241*a* and the second movable portion arc runner 241*b* may be formed by bending a plate or the like. Further, the first movable portion arc runner 241*a* and the second movable portion arc runner 241*b* may be formed to have a sufficient thickness in order to prevent ablation or the like. Further, the first movable portion arc runner 241*a* and the second movable portion arc runner 241*b* may be made of an electrical conductive material such as a metal or an alloy including copper or the like, for example.

By providing the first movable portion arc runner 241*a* and the second movable portion arc runner 241*b*, damage to the first movable contacting portion 121*a* and the second movable contacting portion 121*b* can be reduced so that durability and reliability of the first movable contacting portion 121*a* and the second movable contacting portion 121*b* can be improved. Thus, durability and reliability of the switch device 100 and the jack connector 10 can also be improved.

Other components not specifically explained in the second embodiment are similar to those of the first embodiment. Further, the switch device 100 of the second embodiment may be incorporated into the jack connector 10 explained in the first embodiment. For example, the arc runners of the second embodiment may have various structures and may have bending portions as the first fixed portion arc runner 231*a* and the second fixed portion arc runner 231*b* shown in FIG. 19, for example.

Third Embodiment

Figure 29:
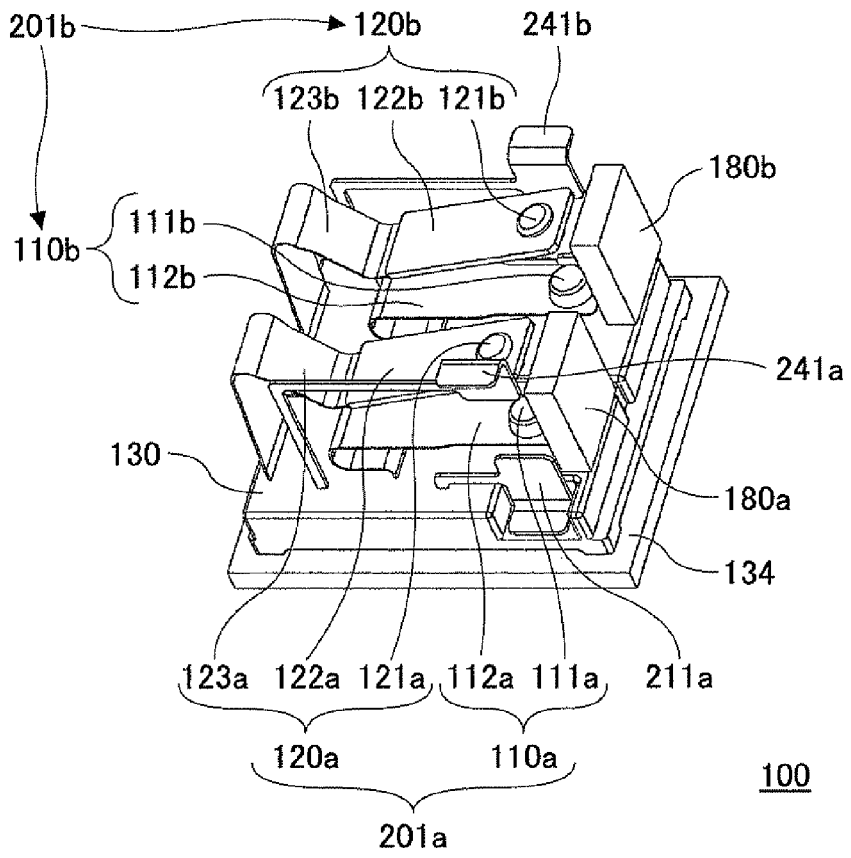
FIG. 29 is a perspective view of an example of the switch device of a third embodiment.
Figure 30:
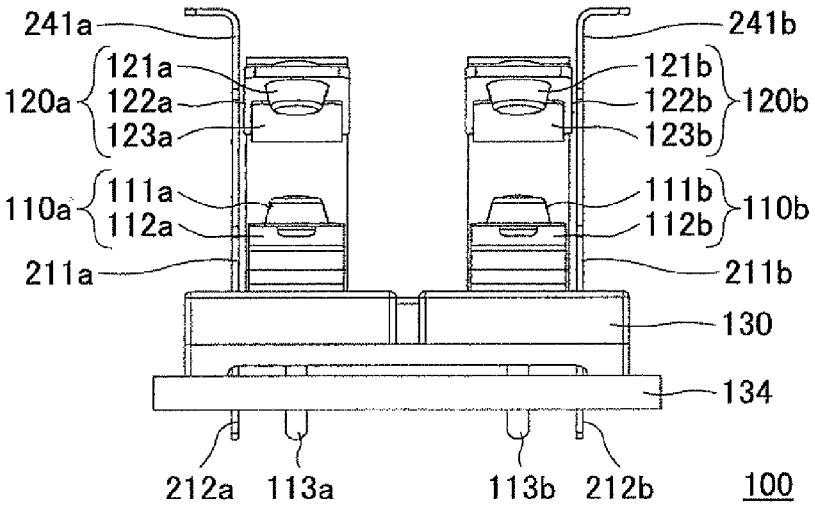
FIG. 30 is an elevation view of an example of the switch device of the third embodiment.
Figure 31:
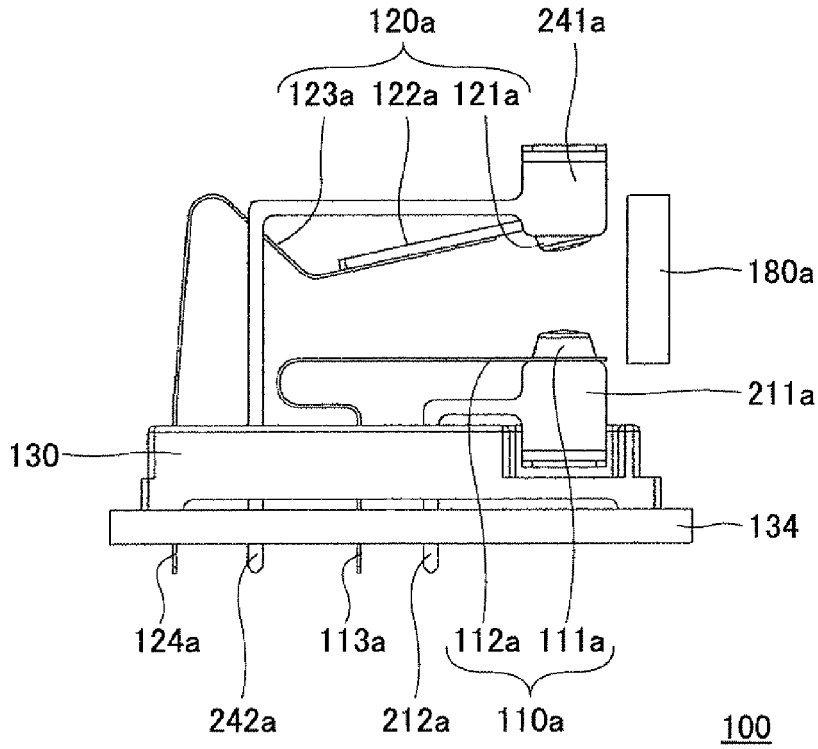
FIG. 31 is a side view of an example of the switch device of the third embodiment.
Figure 32:
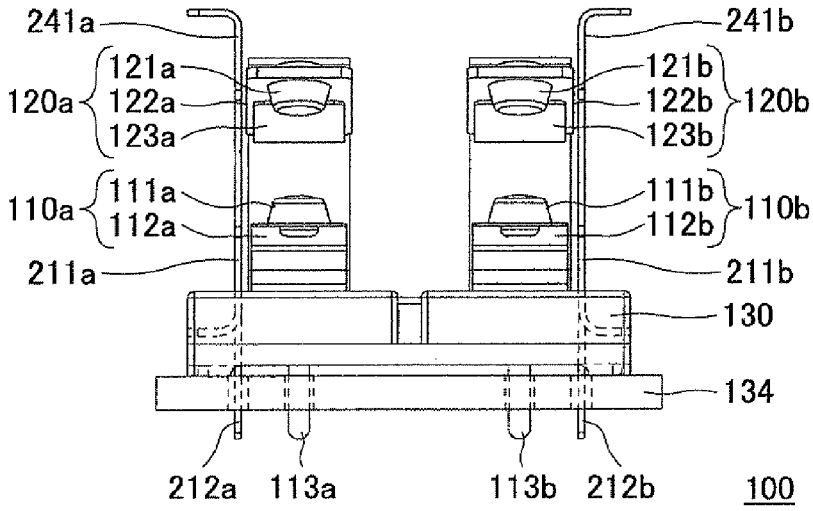
FIG. 32 is an elevation view of an example of the switch device of the third embodiment.
Figure 33:
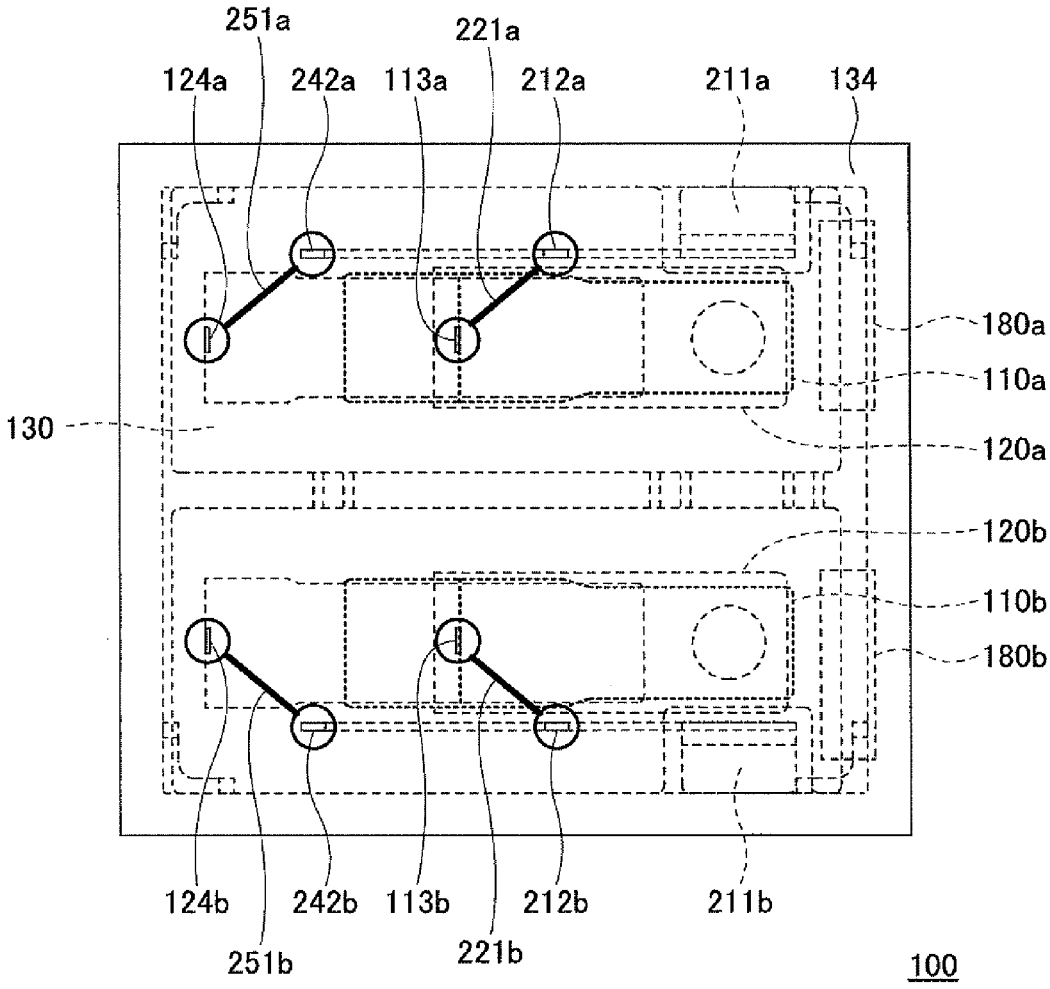
FIG. 33 is a bottom view of an example of the switch device of the third embodiment.

The switch device 100 of the third embodiment is explained with reference to FIG. 29 to FIG. 33. FIG. 29 is a perspective view of an example of the switch device 100, FIG. 30 is an elevation view of an example of the switch device 100, FIG. 31 is a side view of an example of the switch device 100, FIG. 32 is an elevation view of an example of the switch device 100 and FIG. 33 is a bottom view of an example of the switch device 100, of the third embodiment.

In this embodiment, the switch device 100 includes the first fixed portion arc runner 211*a* and the second fixed portion arc runner 211*b* explained in the first embodiment, and the first movable portion arc runner 241*a* and the second movable portion arc runner 241*b* explained in the second embodiment.

In this embodiment, similar to the first embodiment, the fixed portion external terminal 113*a* and the fixed portion arc runner external terminal 212*a* are electrically connected with each other, and the fixed portion external terminal 113*b* and the fixed portion arc runner external terminal 212*b* are electrically connected with each other. Further in this embodiment, similar to the second embodiment, the movable portion external terminal 124*a* and the movable portion arc runner external terminal 242*a* are electrically connected with each other, and the movable portion external terminal 124*b* and the movable portion arc runner external terminal 242*b* are electrically connected with each other.

The above electrical connections may be actualized by wirings (not shown in the drawings) included in the printed circuit board 134, for example, as explained in the first embodiment and the second embodiment.

Alternatively, as shown in FIG. 33, the fixed portion external terminal 113*a* and the fixed portion arc runner external terminal 212*a* may be connected by the wiring 221*a*, and the fixed portion external terminal 113*b* and the fixed portion arc runner external terminal 212*b* may be connected by the wiring 221*b*. Further, the movable portion external terminal 124*a* and the movable portion arc runner external terminal 242*a* may be connected by the wiring 251*a*, and the movable portion external terminal 124*b* and the movable portion arc runner external terminal 242*b* may be connected by the wiring 251*b*, as explained above.

Further, the respective movable portion arc runner and the movable portion, and the respective fixed portion arc runner and the fixed portion may be integrally formed to be connected, or the respective movable portion arc runner and the movable portion, and the respective fixed portion arc runner and the fixed portion may be connected by melting materials composing them by laser or the like to be connected.

In the switch device 100 of the embodiment, the first fixed portion arc runner 211*a* and the second fixed portion arc runner 211*b*, and the first movable portion arc runner 241*a* and the second movable portion arc runner 241*b* are provided. Thus, even when the arc discharges are generated, the arc discharges can be attracted to the first fixed portion arc runner 211*a* from the first fixed contacting portion 111*a*, to the second fixed portion arc runner 211*b* from the second fixed contacting portion 111*b*, to the first movable portion arc runner 241*a* from the first movable contacting portion 121*a*, and to the second movable portion arc runner 241*b* from the second movable contacting portion 121*b*.

Therefore, damage caused by the arc discharges at the first fixed contacting portion 111*a*, the second fixed contacting portion 111*b*, the first movable contacting portion 121*a* and the second movable contacting portion 121*b* can be reduced.

As described above, by the structure of the switch device 100 of the third embodiment, durability and reliability of the first fixed contacting portion 111*a*, the second fixed contacting portion 111*b*, the first movable contacting portion 121*a* and the second movable contacting portion 121*b* can be improved. Thus, durability and reliability of the switch device 100 and the jack connector 10 can also be improved.

Other components not specifically explained in the third embodiment are similar to those of the first and second embodiments. Further, the switch device 100 of the third embodiment may be incorporated into the jack connector 10 explained in the first embodiment. For example, the arc runners of the third embodiment may have various structures and may have bending portions as the first fixed portion arc runner 231*a* and the second fixed portion arc runner 231*b* shown in FIG. 19, for example.

Fourth Embodiment

Figure 34:
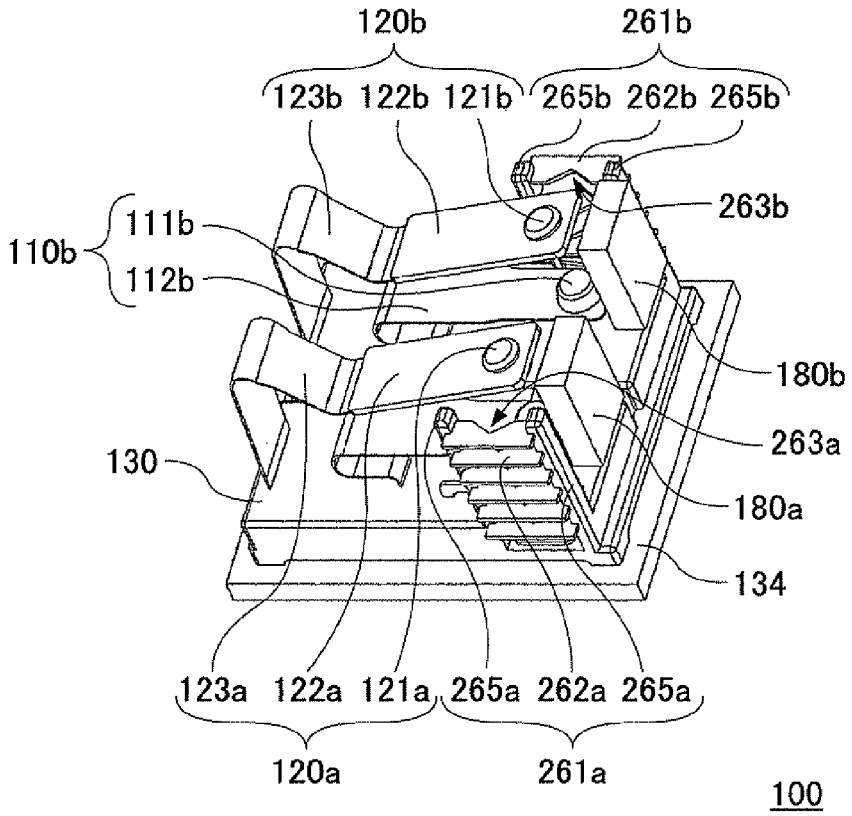
FIG. 34 is a perspective of an example of the switch device of a fourth embodiment switch device.
Figure 35:
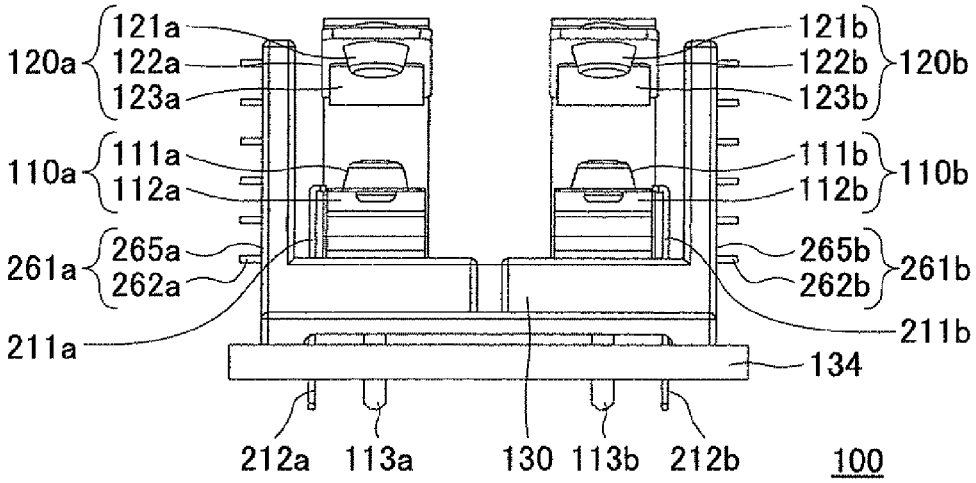
FIG. 35 is an elevation view of an example of the switch device of the fourth embodiment.
Figure 36:
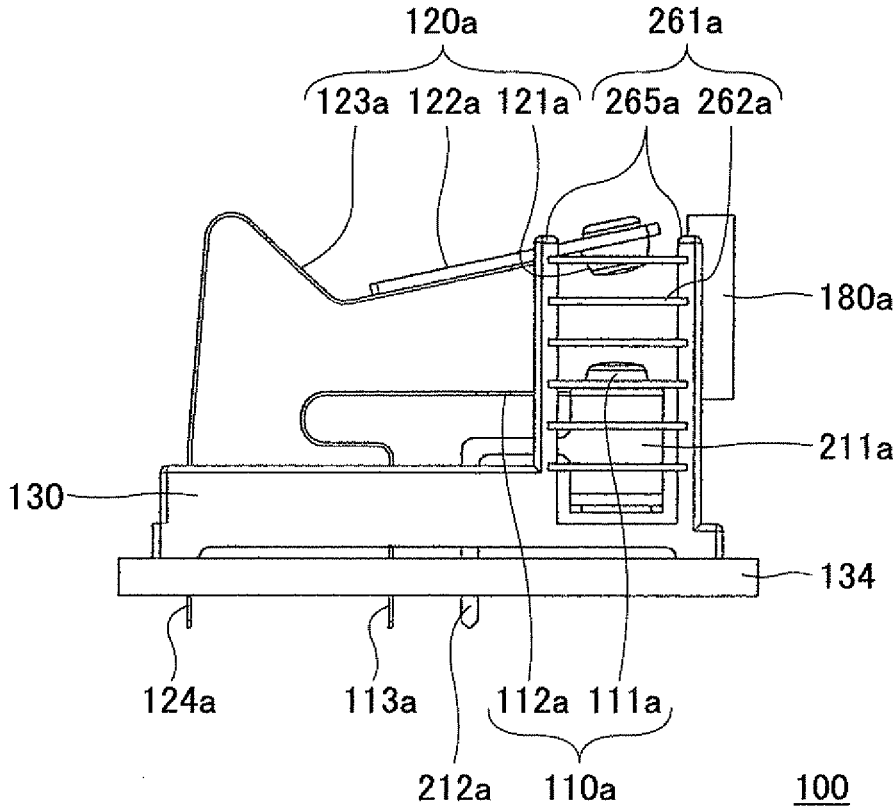
FIG. 36 is a side view of an example of the switch device of the fourth embodiment.
Figure 37:
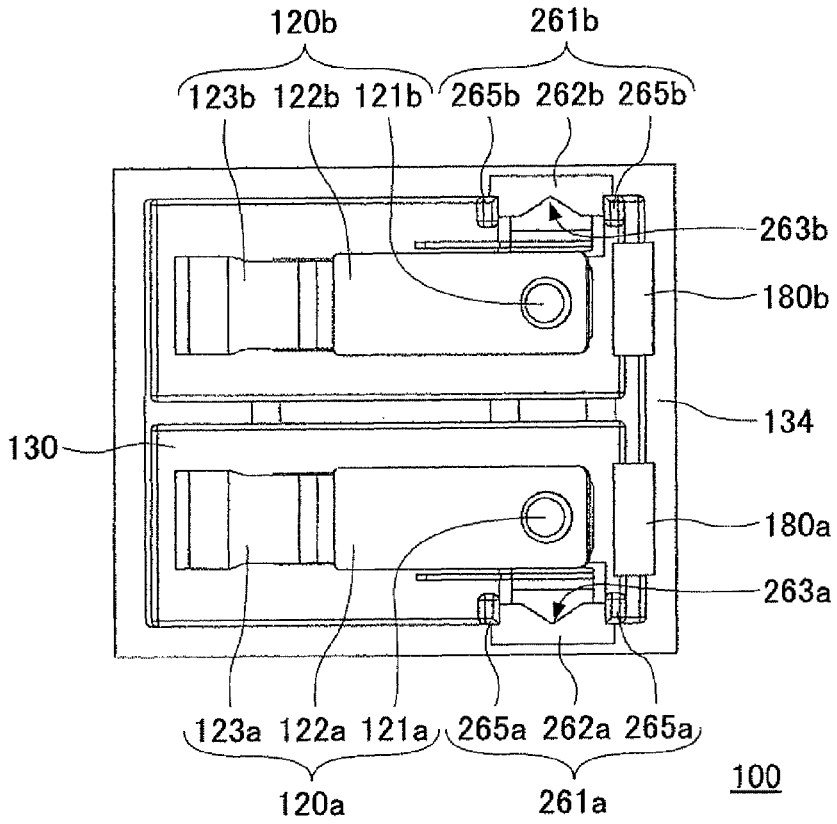
FIG. 37 is a top view of an example of the switch device of the fourth embodiment.
Figure 38:
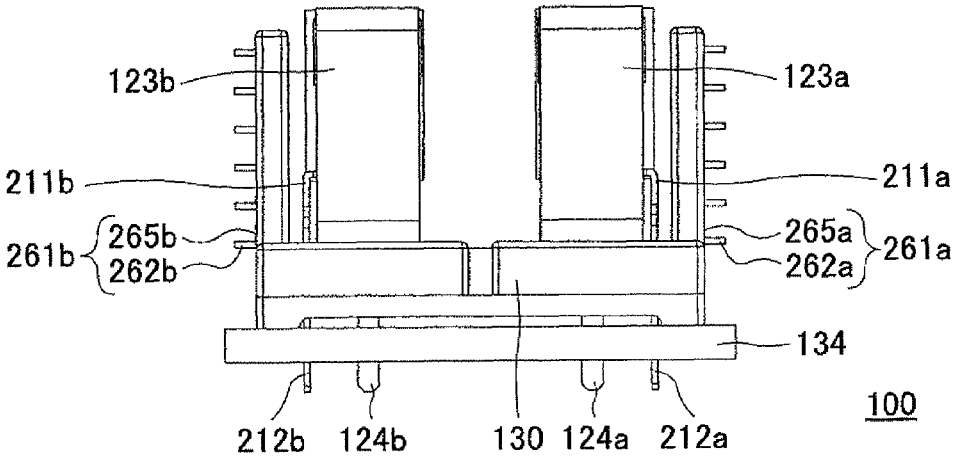
FIG. 38 is a back side view of an example of the switch device of the fourth embodiment.

The switch device 100 of the fourth embodiment is explained with reference to FIG. 34 to FIG. 38. FIG. 34 is a perspective of an example of the switch device 100, FIG. 35 is an elevation view of an example of the switch device 100, FIG. 36 is a side view of an example of the switch device 100, FIG. 37 is a top view of an example of the switch device 100, and FIG. 38 is a back side view of an example of the switch device 100, of the fourth embodiment.

In this embodiment, the switch device 100 includes the first fixed portion arc runner 211*a* and the second fixed portion arc runner 211*b*, similar to the first embodiment. Further, the fixed portion arc runner external terminal 212*a* is connected to the first fixed portion arc runner 211*a*, and the fixed portion arc runner external terminal 212*b* is connected to the second fixed portion arc runner 211*b*.

In this embodiment, the switch device 100 further includes a first attraction portion 261*a* and a second attraction portion 261*b*. The first attraction portion 261*a* is provided at the side of the first fixed contacting portion 111*a* and the first movable contacting portion 121*a* such that the first fixed portion arc runner 211*a* is interposed between the first fixed contacting portion 111*a* and the first movable contacting portion 121*a*, and the first attraction portion 261*a*. Similarly, the second attraction portion 261*b* is provided at the side of the second fixed contacting portion 111*b* and the second movable contacting portion 121*b* such that the second fixed portion arc runner 211*b* is interposed between the second fixed contacting portion 111*b* and the second movable contacting portion 121*b*, and the second attraction portion 261*b*.

The first attraction portion 261*a* includes two pole portions 265*a* and plural notched plates 262*a* which are supported and fixed by the pole portions 265*a*. The pole portions 265*a* are provided to extend in a direction parallel to the direction from the first fixed contacting portion 111*a* toward the first movable contacting portion 121*a*. It means that the pole portions 265*a* are provided to extend in a height direction in FIG. 35.

Each of the notched plates 262*a* is provided with a notch portion 263*a* having a "V" shape seen in a plan view. The notched plates 262*a* are positioned such that the notch portions 263*a* face the first fixed contacting portion 111*a* and the first movable contacting portion 121*a*. In other words, the notch portions 263*a* of the notched plates 262*a* are formed to be tapered in a direction away from the first fixed contacting portion 111*a* and the first movable contacting portion 121*a*.

The plural notched plates 262*a* are put in the direction parallel to the direction from the first fixed contacting portion 111*a* toward the first movable contacting portion 121*a* such that a surface of each of the notched plates 262*a* extends in a direction substantially perpendicular to the direction from the first fixed contacting portion 111*a* toward the first movable contacting portion 121*a*.

By forming such notch portions 263*a*, electric arcs can be further attracted toward the first attraction portion 261*a*.

Similarly, the second attraction portion 261*b* includes two pole portion 265*b* and plural notched plates 262*b* which are supported and fixed by the pole portions 265*b*. The pole portions 265*b* are provided to extend in a direction parallel to the direction from the second fixed contacting portion 111*b* toward the second movable contacting portion 121*b*. It means that the pole portions 265*b* are provided to extend in the height direction in FIG. 35.

Each of the notched plates 262*b* is provided with a notch portion 263*b* having a "V" shape seen in a plan view. The notched plates 262*b* are positioned such that the notch portions 263*b* face the second fixed contacting portion 111*b* and the second movable contacting portion 121*b*. In other words, the notch portions 263*b* of the notched plates 262*b* are formed to be tapered in a direction away from the second fixed contacting portion 111*b* and the second movable contacting portion 121*b*.

The plural notched plates 262*b* are put in the direction parallel to the direction from the second fixed contacting portion 111*b* toward the second movable contacting portion 121*b* such that a surface of each of the notched plates 262*b* extends in a direction substantially perpendicular to the direction from the second fixed contacting portion 111*b* toward the second movable contacting portion 121*b*.

By forming such notch portions 263*b*, electric arcs can be further attracted toward the second attraction portion 261*b*.

In this embodiment, the notched plates 262*a* and 262*b* are formed by processing materials formed in plate-forms. The notched plates 262*a* and 262*b* may be made of a metal material, aluminum oxide ($Al_2O_3$), aluminum nitride (AlN) or the like. For a case using the metal material, the metal material may include an element having a ferromagnetism property such as ferrum (Fe, iron), cobalt (Co), nickel (Ni) or the like. Further, the pole portions 265*a* and 265*b* may be made of resin material or the like.

By forming the notched plates 262*a* and 262*b* with such a material, even when the arc discharges occur, the arc discharges are cooled by the notched plates 262*a* and 262*b* when contacting the notched plates 262*a* so that the arc discharges disappear in a short period.

According to the switch device 100 of the embodiment, the first attraction portion 261*a* including the notched plates 262*a* and the second attraction portion 261*b* including the notched plates 262*b* are provided. Therefore, the arc discharges are easily attracted toward the first attraction portion 261*a* and the second attraction portion 261*b*, respectively. Thus, damage caused by the arc discharges at the first fixed contacting portion 111*a*, the second fixed contacting portion 111*b*, the first movable contacting portion 121*a* and the second movable contacting portion 121*b* can be reduced.

Therefore, durability and reliability of the first fixed contacting portion 111*a*, the second fixed contacting portion 111*b*, the first movable contacting portion 121*a* and the second movable contacting portion 121*b* can be improved so that durability and reliability of the switch device 100 and the jack connector 10 can also be improved.

Other components not specifically explained in the fourth embodiment are similar to those of the first embodiment. Further, the switch device 100 of the fourth embodiment may be incorporated into the jack connector 10 explained in the first embodiment. Further, regarding the structure of the fourth embodiment, the attraction portions may be adapted to the structures of the second embodiment and the third embodiment as well.

According to the above embodiments, a switch device, which can correspond to a power source of a voltage higher than that of the current commercial power source or a direct current power source, with high performance and reliability can be provided. Further, a connector, which can correspond to a power source of a voltage higher than that of the current commercial power source or a direct current power source and safely supply the electric power from the power source, with high performance can be provided.

Although in the above embodiments, the jack connector 10 is explained as an example of a connector including the switch device 100, the switch device 10 may be incorporated in a plug connector.

Further, the plug connector 300 may be configured to be electrically connected to the power source side and the jack connector may be configured to be electrically connected to the electronic device side.

Further, the first movable portion 120*a* and the second movable portion 120*b* may be configured to be electrically connected to the electronic device side, and the first fixed portion 110*a* and the second fixed portion 110*b* may be configured to be electrically connected to the power source side.

In the above embodiments, the magnet unit is configured to include the first permanent magnet 180*a* and the second permanent magnet 180*b*. In other words, the first permanent magnet 180*a* and the second permanent magnet 180*b* are provided respectively for the first contacting portion 201*a* and the second contacting portion 201*b*. However, the first permanent magnet 180*a* and the second permanent magnet 180*b* may be formed to be a common magnet for the first contacting portion 201*a* and the second contacting portion 201*b*. It means that the magnet unit may include a single magnet commonly provided for the first contacting portion 201*a* and the second contacting portion 201*b*.

Further, although not shown in the drawings, the first fixed portion arc runner 211*a* shown in FIG. 13 to FIG. 17 may also be configured to be positioned such that the distance between the first fixed portion arc runner 211*a* and the first movable contacting portion 121*a* is shorter than the distance between the first fixed contacting portion 111*a* and the first movable contacting portion 121*a* when the first movable contacting portion 121*a* takes a position (an example of a first position where the first movable contacting portion 121*a* is apart from the first fixed contacting portion 111*a*) as shown in FIG. 11 where the operation unit 40 is positioned at the "OFF" position (see FIG. 9). Similarly, the second fixed portion arc runner 211*b* shown in FIG. 13 to FIG. 17 may also be configured to be positioned such that the distance between the second fixed portion arc runner 211*b* and the second movable contacting portion 121*b* is shorter than the distance between the second fixed contacting portion 111*b* and the second movable contacting portion 121*b* when the second movable contacting portion 121*b* takes a position (an example of a third position where the second movable contacting portion 121*b* is apart from the second fixed contacting portion 111*b*) as shown in FIG. 11 where the operation unit 40 is positioned at the "OFF" position (see FIG. 9). However, the first fixed portion arc runner 211*a* and the second fixed portion arc runner 211*b* may be provided such that there are appropriate spaces between the first fixed portion arc runner 211*a* and the first movable contacting portion 121*a* and between the second fixed portion arc runner 211*b* and the second movable contacting portion 121*b* when the first movable contacting portion 121*a* and the second movable contacting portion 121*b* take the position as shown in FIG. 11, respectively.

Further, although not shown in the drawings, the first movable portion arc runner 241*a* shown in FIG. 24 to FIG. 28 may also be configured to be positioned such that the distance between the first movable portion arc runner 241*a* and the first fixed contacting portion 111*a* is shorter than the distance between the first movable contacting portion 121*a* and the first fixed contacting portion 111*a* when the first movable contacting portion 121*a* takes the position as shown in FIG. 11. Similarly, the second movable portion arc runner 241*b* shown in FIG. 24 to FIG. 28 may also be configured to be positioned such that the distance between the second movable portion arc runner 241*b* and the second fixed contacting portion 111*b* is shorter than the distance between the second movable contacting portion 121*b* and the second fixed contacting portion 111*b* when the second movable contacting portion 121*b* takes the position as shown in FIG. 11. However, in this case as well, the first movable portion arc runner 241*a* and the second movable portion arc runner 241*b* may be provided such that there are appropriate spaces between the first movable portion arc runner 241*a* and the first fixed contacting portion 111*a* and between the second movable portion arc runner 241*b* and the second fixed contacting portion 111*b*, respectively.

Although a preferred embodiment of the connector or the switch device has been specifically illustrated and described, it is to be understood that minor modifications may be made therein without departing from the sprit and scope of the invention as defined by the claims.

The present invention is not limited to the specifically disclosed embodiments, and variations and modifications may be made without departing from the scope of the present invention.

The present application is based on Japanese Priority Application No. 2011-176407 filed on Aug. 11, 2011, the entire contents of which are hereby incorporated herein by reference.

What is claimed is:

1. A switch device comprising:

a first contacting portion including a first fixed contacting portion and a first movable contacting portion configured to contact the first fixed contacting portion;

a second contacting portion including a second fixed contacting portion and a second movable contacting portion configured to contact the second fixed contacting portion, the first fixed contacting portion and the second fixed contacting portion being configured to be electrically connected to one of a power source and an electronic device while the first movable contacting portion and the second movable contacting portion are configured to be electrically connected to the other of the power source and the electronic device;

a first electric arc runner provided near one of the first fixed contacting portion and the first movable contacting portion and having a function to attract an arc discharge generated between the first fixed contacting portion and the first movable contacting portion; and a second electric arc runner provided near one of the second fixed contacting portion and the second movable contacting portion and having a function to attract an arc discharge generated between the second fixed contacting portion and the second movable contacting portion.

2. The switch device according to claim 1, wherein the first electric arc runner is provided at a side of the one of the first fixed contacting portion and the first movable contacting portion, and the second electric arc runner is provided at a side of the one of the second fixed contacting portion and the second movable contacting portion.

3. The switch device according to claim 1, wherein the first electric arc runner is electrically connected to the one of the first fixed contacting portion and the first movable contacting portion, and the second electric arc runner is electrically connected to the one of the second fixed contacting portion and the second movable contacting portion.

4. The switch device according to claim 3, wherein the first movable contacting portion is configured to take a first position where the first movable contacting portion is apart from the first fixed contacting portion, and the second movable contacting portion is configured to take a second position where the second movable contacting portion is apart from the second fixed contacting portion, the first electric arc runner is configured to be positioned such that the distance between the first electric arc runner and the other of the first fixed contacting portion and the first movable contacting portion is shorter than the distance between the one of the first fixed contacting portion and the first movable contacting portion and other of the first fixed contacting portion and the first movable contacting portion when the first movable contacting portion takes the first position, and the second electric arc runner is configured to be positioned such that the distance between the second electric arc runner and the other of the second fixed contacting portion and the second movable contacting portion is shorter than the distance between the one of the second fixed contacting portion and the second movable contacting portion and the other of the second fixed contacting portion and the second movable contacting portion when the first movable contacting portion takes the third position.

5. The switch device according to claim 1, wherein the first electric arc runner includes a bending portion bent toward the first fixed contacting portion and the first movable contacting portion and the second electric arc runner includes a bending portion bent toward the second fixed contacting portion and the second movable contacting portion.

6. The switch device according to claim 1, wherein the first electric arc runner and the second electric arc runner are provided at sides of the first fixed contacting portion and the second fixed contacting portion, respectively, and the switch device further comprising:

a third electric arc runner provided at a side of the first movable contacting portion and having a function to attract an arc discharge generated between the first fixed contacting portion and the first movable contacting portion; and a fourth electric arc runner provided near at a side of the second movable contacting portion and having a function to attract an arc discharge generated between the second fixed contacting portion and the second movable contacting portion.

7. The switch device according to claim 6, wherein the first electric arc runner is electrically connected to the first fixed contacting portion, the second electric arc runner is electrically connected to the second fixed contacting portion, the third electric arc runner is electrically connected to the first movable contacting portion, and the fourth electric arc runner is electrically connected to the second movable contacting portion.

8. The switch device according to claim 1, further comprising:

a first attraction portion including plural attraction plates and provided at a side of the first fixed contacting portion and the first movable contacting portion; and a second attraction portion including plural attraction plates and provided at a side of the second fixed contacting portion and the second movable contacting portion.

9. The switch device according to claim 8, wherein each of the attraction plates of the first attraction portion is provided with a notch portion formed to face the first fixed contacting portion and the first movable contacting portion, and each of the attraction plates of the second attraction portion is provided with a notch portion formed to face the second fixed contacting portion and the second movable contacting portion.

10. The switch device according to claim 1, wherein the attraction plates are made of a material including an element having a ferromagnetism property.

11. A connector for electrically connecting a power source and an electronic device, comprising:

a first contacting portion including a first fixed contacting portion and a first movable contacting portion configured to contact the first fixed contacting portion;

a second contacting portion including a second fixed contacting portion and a second movable contacting portion configured to contact the second fixed contacting portion;

a first electric arc runner provided near one of the first fixed contacting portion and the first movable contacting portion and having a function to attract an arc discharge generated between the first fixed contacting portion and the first movable contacting portion; and a second electric arc runner provided near one of the second fixed contacting portion and the second movable contacting portion and having a function to attract an arc discharge generated between the second fixed contacting portion and the second movable contacting portion; and a first fitting terminal and a second fitting terminal configured to be electrically connected to one of the first fixed contacting portion and the first movable contacting portion, and one of the second fixed contacting portion and the second movable contacting portion, to be fitted with terminals of another connector which is electrically connected to one of a power source and an electronic device, respectively, the other of the first fixed contacting portion and the first movable contacting portion, and the other of the second fixed contacting portion and the second movable contacting portion being configured to be electrically connected to the other of the power source and the electronic device.

* * * * *